United States Patent [19]

Conner, Jr.

[11] 4,213,547

[45] Jul. 22, 1980

[54] METHOD OF AND APPARATUS FOR PROCESSING PARTS OF GARMENTS, SUCH AS COLLARS

[75] Inventor: William R. Conner, Jr., Shelbyville, Tenn.

[73] Assignee: Stahl-Urban Company, Shelbyville, Tenn.

[21] Appl. No.: 948,558

[22] Filed: Oct. 4, 1978

[51] Int. Cl.[2] ..... A41H 43/00; A41H 33/00

[52] U.S. Cl. ..... 223/2; 38/144; 83/901; 223/52.1

[58] Field of Search ..... 223/2, 52, 1, 39, 61; 83/901; 38/12, 144

[56] References Cited

U.S. PATENT DOCUMENTS

| | | | |
|---|---|---|---|
| 1,299,039 | 4/1919 | Sager | 223/2 |
| 2,553,194 | 5/1951 | Hovell | 223/2 |
| 2,619,267 | 11/1952 | Voigt | 223/2 |
| 2,721,011 | 10/1955 | Greco et al. | 223/2 |
| 2,804,244 | 8/1957 | Hunt | 223/2 |
| 2,909,307 | 10/1959 | Hunt et al. | 223/2 |
| 2,995,279 | 8/1961 | Hunt | 223/2 |
| 3,633,799 | 1/1972 | Pettit | 223/2 |
| 3,901,420 | 8/1975 | Revuelta | 223/52.1 |

*Primary Examiner*—Louis Rimrodt

*Attorney, Agent, or Firm*—Senniger, Powers, Leavitt and Roedel

[57] ABSTRACT

Method of and apparatus for processing run-stitched collars, in which the points of the collars are trimmed, and the collars are everted and pressed. In the pressing operation, the collars are given a wiping action.

31 Claims, 26 Drawing Figures

METHOD OF AND APPARATUS FOR PROCESSING PARTS OF GARMENTS, SUCH AS COLLARS

BACKGROUND OF THE INVENTION

This invention relates to apparatus for processing parts of garments, and more particularly to apparatus for trimming, turning and pressing runstitched collars.

In a widely used mode of manufacture of shirt collars, the collars are formed by assembling flatwise one on another three plies of material cut to the desired shape of the collar, thereby having a top edge, a bottom edge (which is usually concavely curved) and inclined end edges, and then runstitching the plies together. By "runstitching" is meant that the plies are stitched together along one end edge, the bottom edge and the other end edge on a line of stitching spaced inward of these three edges, the plies remaining free of one another along the top edge (the fourth edge). Generally, two of the plies are cut from the shirt fabric material and the third ply is cut from a relatively stiff fabric to constitute an interliner. The plies are assembled with the two shirt fabric plies one against the other, with their faces which are ultimately to be on the outside of the collar on the inside one against the other, and with the interliner on one of the shirt fabric plies. In the subsequent stage of manufacture, the runstitched collar is processed by trimming its points (i.e., the corners of the intersections of the end edges and the bottom edge), turning (everting) it to bring the two plies of shirt fabric on the outside of the interliner with their faces which were on the inside now on the outside, and then pressing the turned collar.

This invention has been developed especially for the trimming and turning of runstitched collars and the pressing of the turned collar. The invention may be regarded as an improvement on prior apparatus for this purpose which has been commercially available, such as the AUTOPRESS II Model 9900 Collar Machine sold by Teledyne Amco of Reading, Pennsylvania, the basic features of which may be ascertained from the U.S. Pat. No. 3,633,799 issued Jan. 11, 1972. Reference may also be made to U.S. Pat. Nos. 2,553,194; 2,619,267; 2,804,244, and 2,995,279 as relevant prior art.

While the AUTOPRESS II machine has been in use for many years, and is believed to be the most widely used collar trimming, turning and pressing machine, it does not enable production of collars with as neat and even a bottom edge as may be desired without time-consuming extra manual rolling of the edge, and may not enable as rapid a rate of production as may be desired.

SUMMARY OF THE INVENTION

Among the several objects of the invention may be noted the provision of an improved method of and apparatus for processing parts of garments adapted for the rapid processing of the parts to obtain a neat and even seamed edge of each part, without extra manual operations; the provision of such a method and apparatus, particularly for processing runstitched collars, involving trimming, turning and pressing of the collars, the pressing being a special feature of the invention such as to obtain a neat and even bottom edge for the collar without extra manual rolling of the edge; and the provision of such an apparatus which is relatively easy for an operator to use, which reduces the processing time per collar, and which is reliable in operation.

In general, apparatus of this invention, adapted for processing workpieces such as parts of garments each of which comprises two or more superimposed plies of material which have been seamed adjacent an edge thereof and which are unseamed at an edge opposite the seamed edge, comprises means for holding a workpiece in a turned condition with the seam inturned, the plies of the workpiece thereby having inturned margins at the stated edge joined by the seam. The holding means is adapted to extend between plies of the workpiece from the unseamed edge thereof and has an edge which is receivable in the infolded margin of a ply and which is engageable with the workpiece at its seamed edge. The apparatus also comprises a press for pressing a workpiece on the holding means, the press comprising a pair of platens for pressing engagement with opposite faces of a workpiece on the holding means. The platens are relatively movable away from one another to a retracted position wherein they are spaced apart (and thereby open) for entry of the holding means carrying a workpiece between the platens with one face of the workpiece being toward the first platen and its other face facing toward the second platen. The holding means is movable from a loading position spaced from the press, where a workpiece may be applied to the holding means in the stated turned condition, to a pressing position between the opened platens, the apparatus having means for moving the holding means between its loading and pressing positions. The apparatus further comprises means for effecting relative movement of the platens for closure thereof to press the opposite faces of the workpiece on the holding means and concomitantly effecting a relative movement of at least one of the platens and the holding means in a direction to effect a wiping action on the workpiece drawing it in the direction away from the seamed edge of the workpiece held at said edge of the holding means toward the unseamed edge of the workpiece.

The method of the invention generally comprises applying the workpiece to a holding means in a turned condition with the seam inturned, the plies of the workpiece thereby having inturned margins at said edge joined by the seam, the holding means extending between plies of the workpiece from the unseamed edge thereof and having an edge received in the infolded margin of a ply and engageable with the workpiece at its seamed edge, positioning the holding means with the turned workpiece thereon between a pair of pressing platens, and effecting relative movement of the platens for closure thereof to press the opposite faces of the workpiece on the holding means and concomitantly effecting a relative movement of at least one of the platens and the holding means in a direction to effect a wiping action on the workpiece drawing it in the direction away from the seamed edge of the workpiece held at said edge of the holding means toward the unseamed edge of the workpiece.

Other objects and features will be in part apparent and in part pointed out hereinafter.

The invention accordingly comprises the constructions and methods hereinafter described, the scope of the invention being indicated in the following claims.

BRIEF DESCRIPTION OF THE DRAWINGS

Corresponding reference characters indicate corresponding parts throughout the several views of the drawings.

DESCRIPTION OF THE PREFERRED EMBODIMENT

Figure 21:
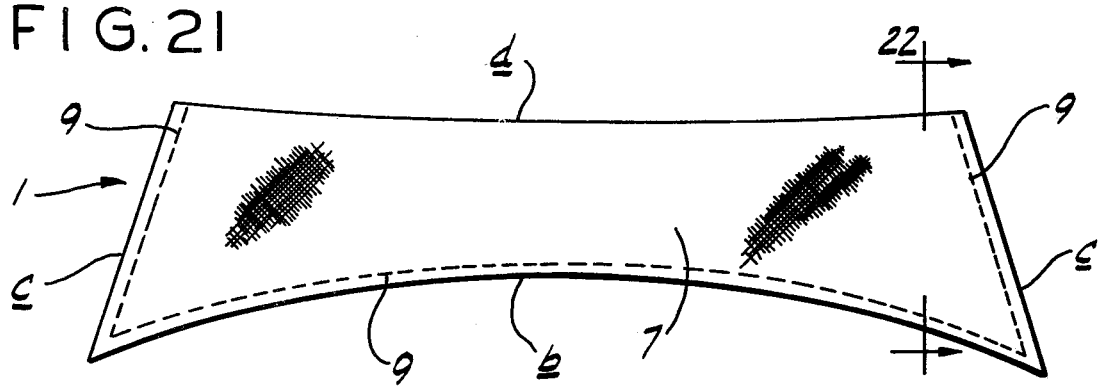
FIG. 21 (sheet 11) is a view in elevation of a runstitched collar.
Figure 22:
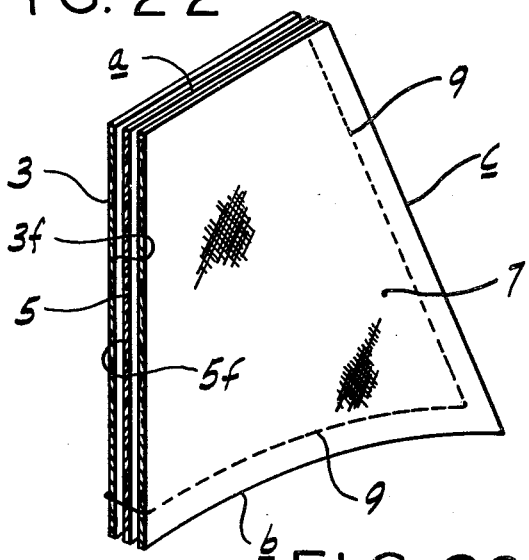
FIG. 22 (sheet 11) is an enlarged section on line 22—22 of FIG. 21.

Referring to the drawings, there is generally indicated at A in FIGS. 1–6 apparatus of this invention for processing workpieces 1, more particularly runstitched collars of the type particularly illustrated in FIGS. 21 and 22 comprising three plies of material 3, 5 and 7, each cut to the desired shape for the collar, thereby having a long side edge a, constituting its top edge, a long side edge constituting its bottom edge b, and end edges c. The top edge a is straight or substantially so. The bottom edge b may be concavely curved, as shown. The end edges c are straight and may be inclined as shown; that is to say, they diverge away from one another from the top to the bottom of the collar. Plies 3 and 5 are generally cut from shirt fabric, i.e., the fabric from which the shirt on which the collar is to be used is to be made. Ply 7 is cut from a relatively stiff material to constitute an interliner (and may have collar stays secured thereto). The plies are assembled (see FIG. 22) with ply 5 on ply 3, with the faces 5f and 3f of these plies which ultimately are to be on the outside of the collar on the inside one against the other, and with the interliner ply 7 on ply 5. So assembled, the plies are runstitched by stitching them together along one end edge c, the bottom edge b and the other end edge c, this stitching being indicated at 9 in FIGS. 21 and 22, leaving the plies free of one another (i.e., leaving the runstitched collar open) along the top edge a (the fourth edge). This opening at the top edge enables the runstitched collar to be turned as will appear.

Figure 16:
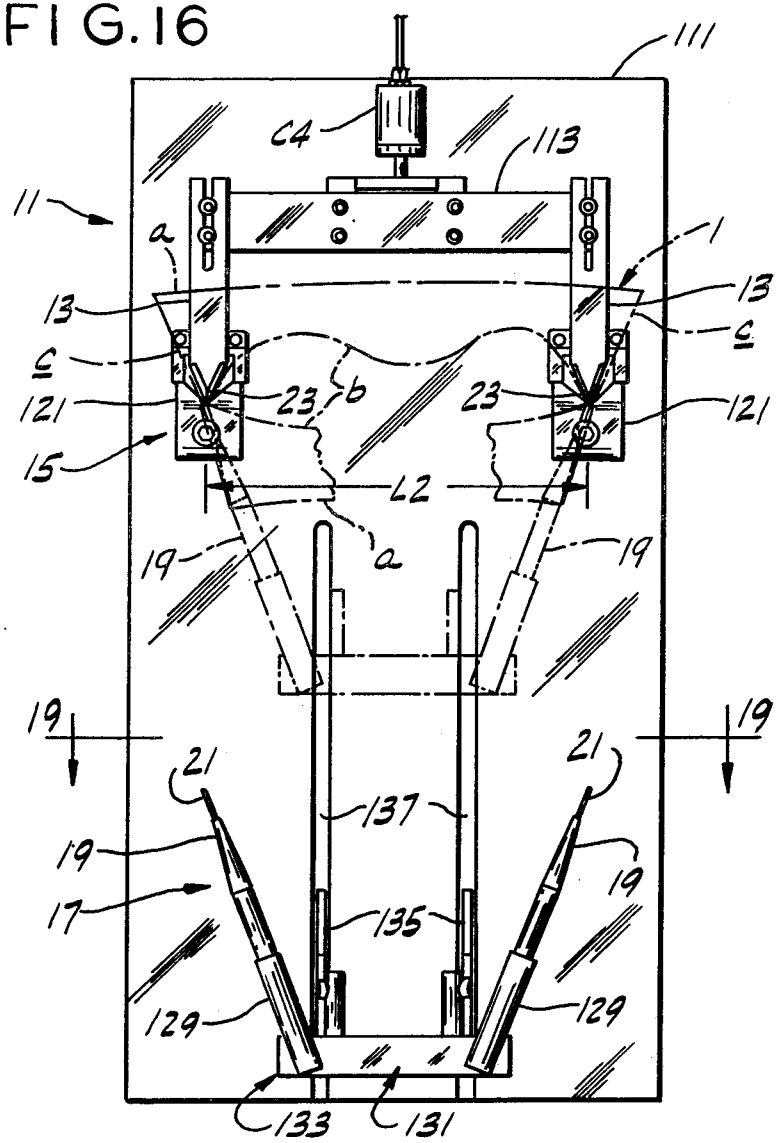
FIG. 16 (sheet 9) is a front elevation of a collar trimming and turning unit of the apparatus.
Figure 20:
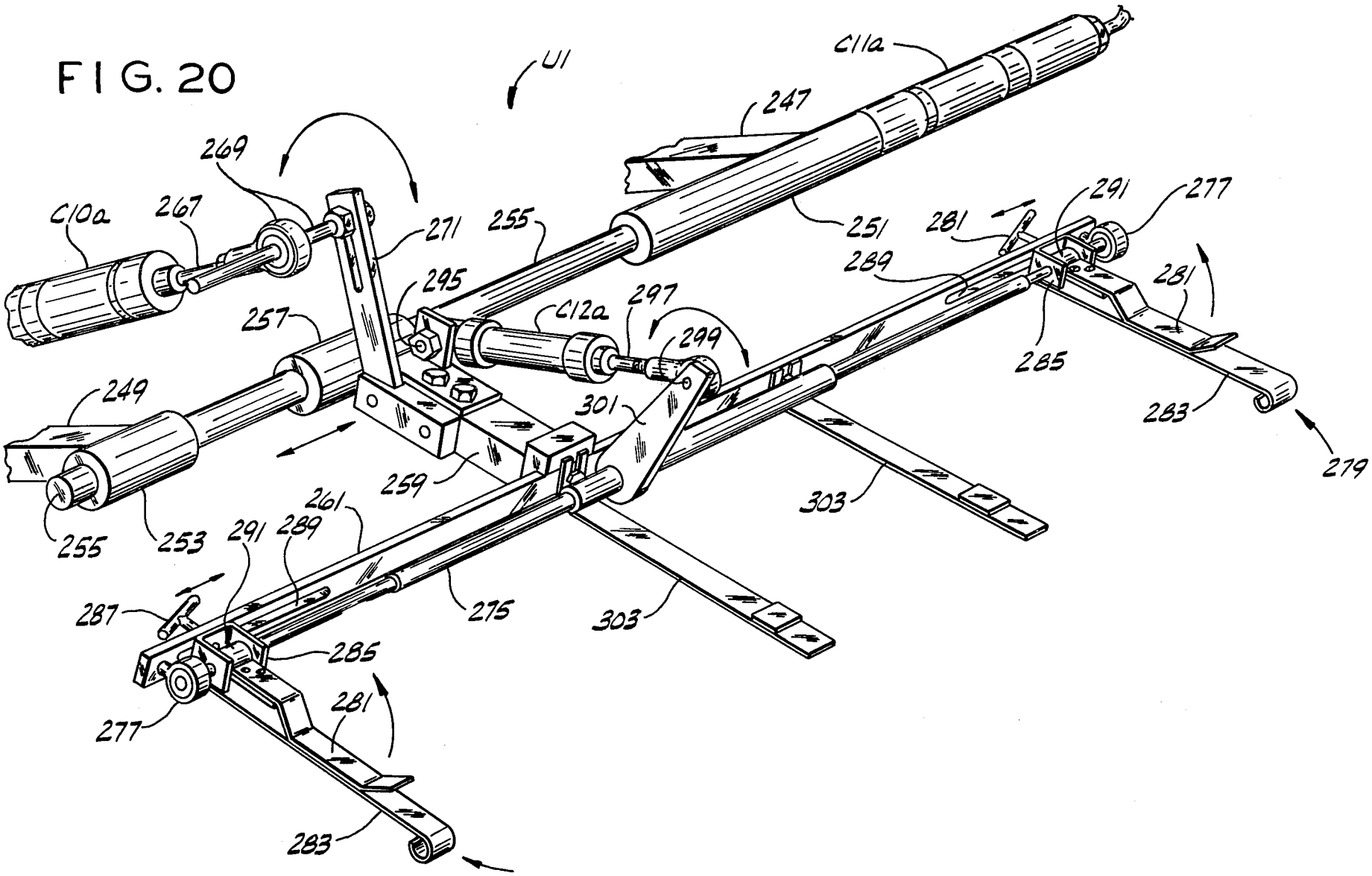
FIG. 20 (sheet 10) is a perspective of one of two unloaders of the apparatus.
Figure 23:
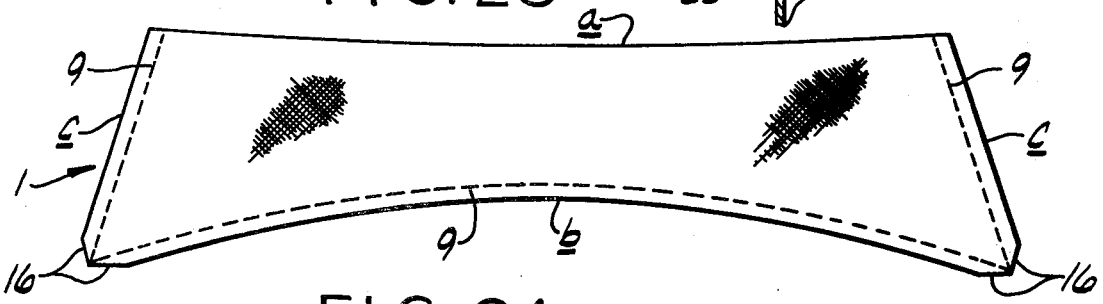
FIG. 23 (sheet 11) is a view similar to FIG. 21 showing the points of the collar trimmed.
Figure 24:
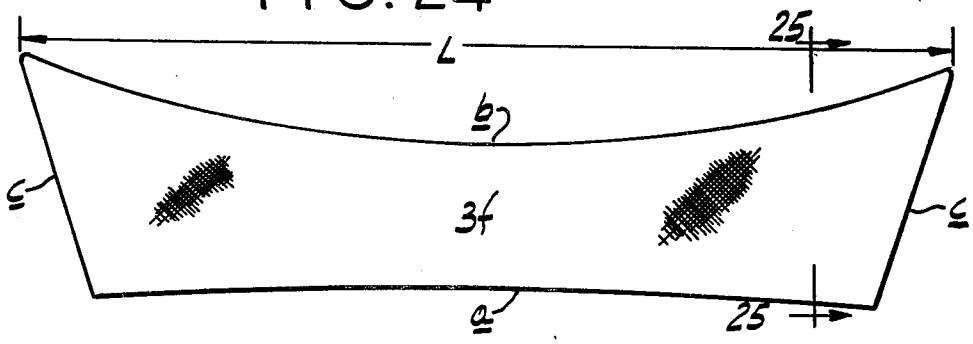
FIG. 24 (sheet 11) is a view showing the collar turned (everted)

The apparatus A, as it has been developed for processing runstitched collars 1 as above described, comprises means indicated generally at 11 and comprising a pair of members 13 which may be referred to as upper turning points for receiving a collar in its runstitched condition and holding the collar for having its points trimmed by trimming means indicated generally at 15 (see FIG. 16). In this trimming operation, the points of the collar are trimmed off as indicated at 16 in FIG. 23. The upper turning points 13 also constitute part of a means 17 for turning the trimmed collar and transferring it to one or the other of two forms F1, F2 (see FIGS. 1 and 8), each constituting means for holding a turned collar as will appear. This turning means 17 comprises a pair of members 19 which may be referred to as lower turning points, adapted to receive the collar from the upper turning points 13 with accompanying turning of the collar to evert it from its original runstitched condition of FIGS. 21 and 22 (plies 3 and 5 together in outside in condition, interliner 7 on ply 5) to its condition of FIGS. 24 and 25 wherein interliner 7 is sandwiched between plies 3 and 5 and faces f of plies 3 and 5 are on the outside. This is the final disposition of the plies. In everting the runstitched collar, the stitched seam along the ends and bottom of the collar are brought to the inside between the plies 3 and 5 (now the outer plies of the collar). The lower turning points 19 are movable from a first (lowered) position spaced down from the upper turning points 13, enabling application of the runstitched collar C to the upper turning points, to a second (raised) position wherein their upper ends 21 engage the lower pointed ends 23 of the upper turning points for transfer of a collar from the upper to the lower turning points with accompanying eversion of the collar. This transfer is effected by pulling the collar down off the upper and onto the lower turning points.

Figure 1:
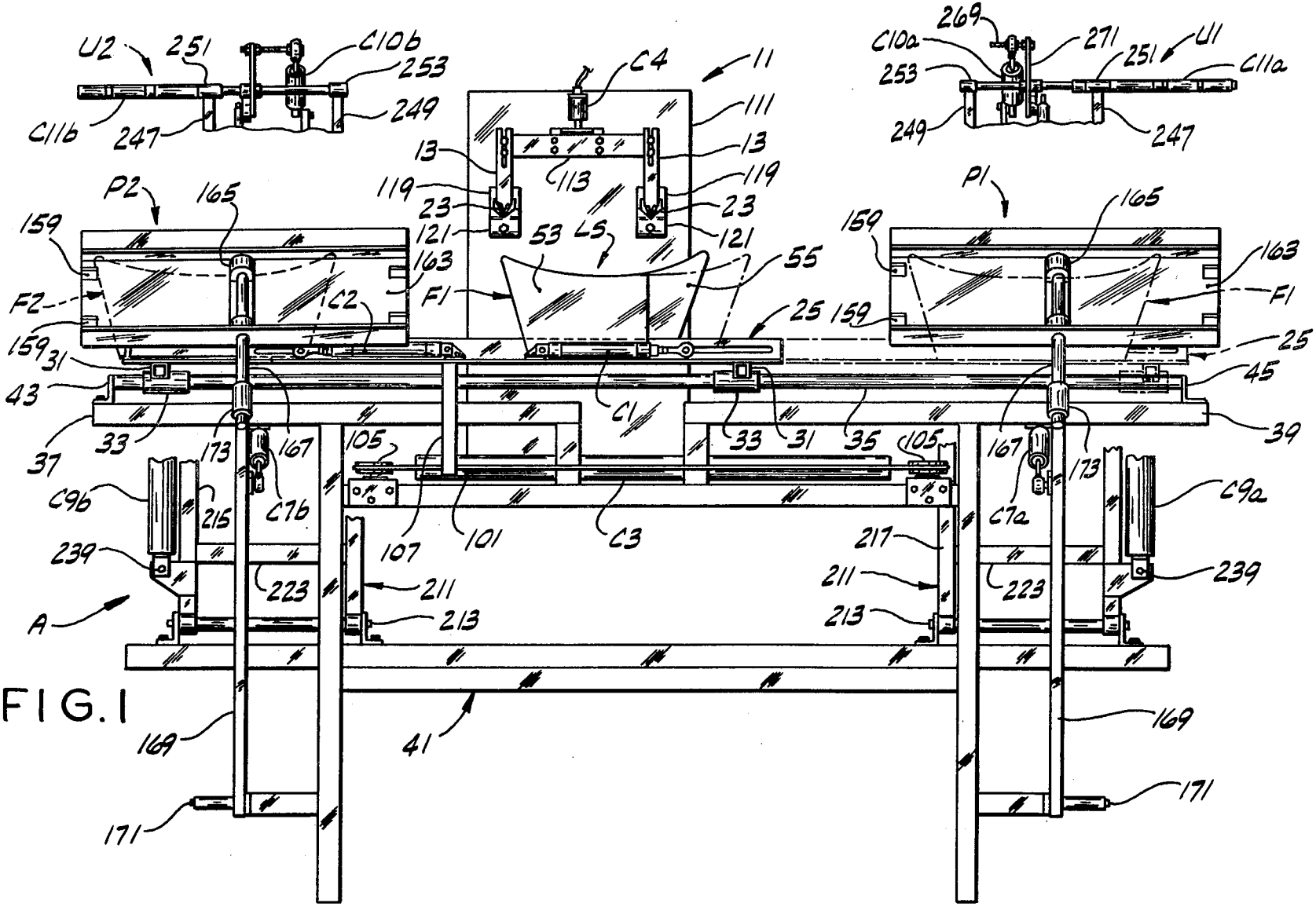
FIG. 1 (sheet 1) is a front elevation of an apparatus of this invention, with parts broken away.

The forms F1 and F2 are carried by a main carriage generally designated 25 movable from left to right and back from right to left of the apparatus as viewed from the front (as viewed in FIG. 1). The apparatus has a first press P1 at the right and a second press P2 at the left, and the carriage is movable between a position, which may be referred to as its first position, and wherein the form F1 is at a loading position or station LS between the presses and the form F2 is in the left-hand press P2, and a second position wherein the form F2 is at the loading station LS and the form F1 is in the righthand press. The forms F1 and F2 are arranged right and left on the carriage 25. They are so spaced, one from the other, and the stroke of the carriage (and hence the stroke of the forms) is such as to effect the positioning of form F2 in press P2 and form F1 at the loading station LS at one end (the left end) of the stroke and the positioning of form F1 in press P1 and form F2 at the loading station at the other end (the right end) of the stroke of the carriage. The forms F1 and F2 are so called because they are adapted to form the collar to its desired shape; for this purpose they are collapsible and expansible endwise, being collapsed for application thereto of a collar and expanded for stretching the collar endwise, all as will appear. The lower turning points 19 are movable up and down at the loading station, the arrangement being such that as they move down to their lowered position, the turned collar thereon may be transferred, with a minimum of manipulation, to the form F1 or F2 which is at the loading station, and which is collapsed at this time for the transfer. Then, the form carrying the turned collar is expanded to stretch (i.e., to form) the collar. The carriage 25 is then moved to move the form carrying the turned and stretched collar into the press P1 or P2, as the case may be, and as will appear.

Figure 8:
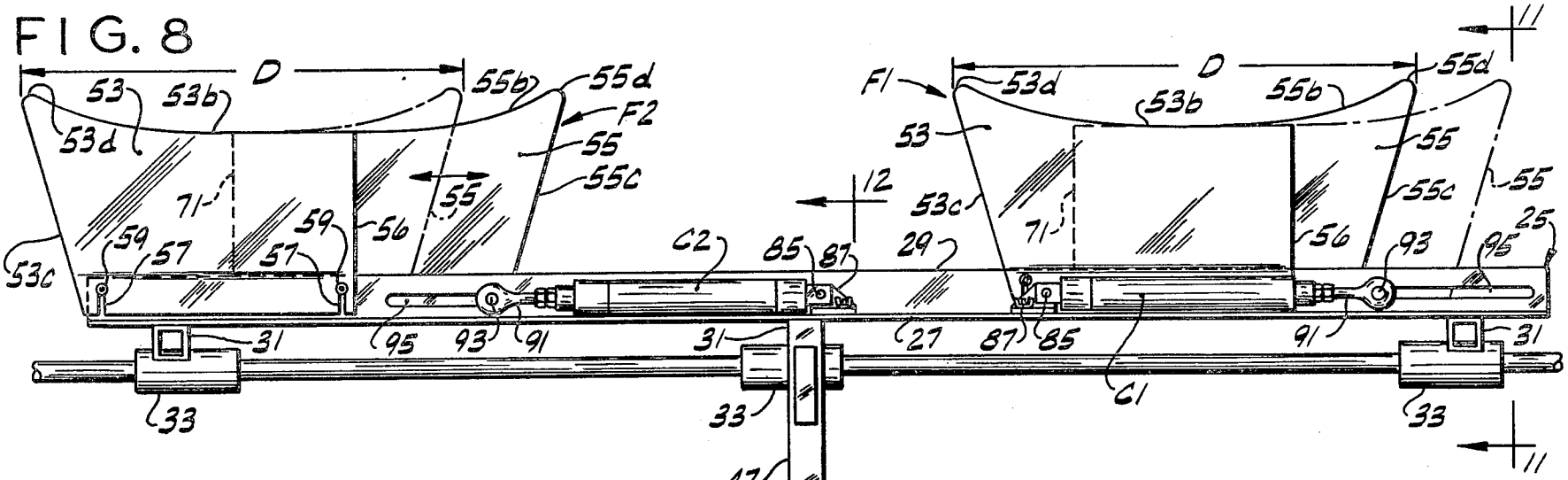
Figure 9:
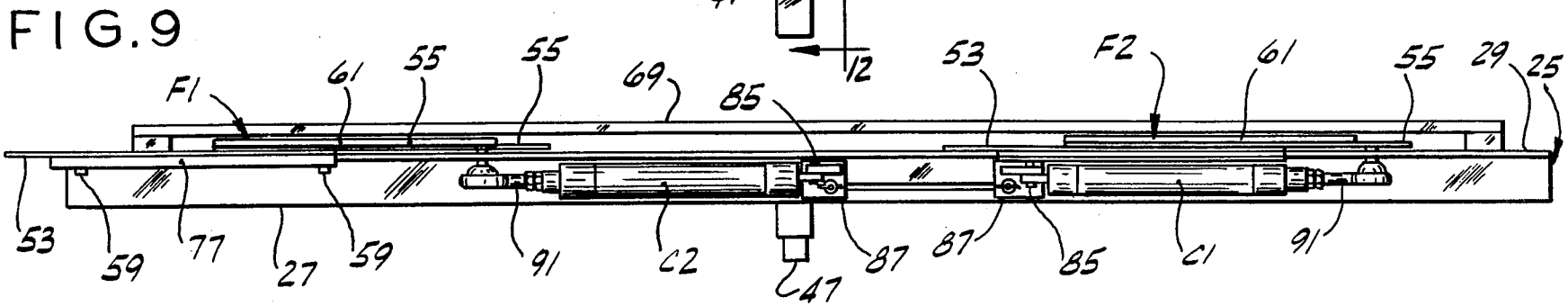
FIG. 9 (sheet 6) is a plan of FIG. 8.

Referring particularly to FIGS. 8 and 9, the main carriage 25 (which carries the two forms F1 and F2) is shown to comprise an elongate bar of L-shape in section (constituted by an aluminum angle bar, for example), one leg 27 of which constitutes a bottom leg, the other leg 29 extending up from the bottom leg at the back edge of the bottom leg. The bottom leg 27 is secured on top of three bracket arms 31 mounted on three tubular guides 33 slidable on a guide rod 35 extending above the upper front bars 37 and 39 of the frame 41 of the apparatus from a support 43 on bar 37 at its left end to a support 45 on bar 39 at its right end. The guides 33, slidable on rod 35, guide the carriage 25 for sliding movement in the direction of its length between the first position toward the left in which the carriage is illustrated in solid lines in FIG. 1 and the second position toward the right in which the carriage is illustrated in phantom in FIG. 1. The carriage is held against swinging around the axis of the rod 35 and maintained in an angled position with its bottom leg 27 angled up toward the front of the apparatus and its upwardly extending leg 29 in an inclined plane angled rearward off vertical about 14½° from its bottom to its top by means of an outboard guide member 47 extending down from the arm 31 on the central tubular guide 33, member 47 carrying guide rollers 49 at its lower end rolling on an outboard guide bar 51 at the front of the frame 41 of the apparatus (see FIG. 12).

The right-hand (the first) form F1 comprises a first blade 53 which is removably mounted on the carriage in fixed relation thereto and a second blade 55 which is mounted on the carriage for longitudinal movement relative to the carriage (and relative to the first blade) away from the retracted position shown in solid lines at the right of FIG. 8, wherein the ends of the blades are spaced a distance D less than the length L of a collar to enable a collar to be placed on the blades, to the extended position shown in phantom at the right of FIG. 8 for stretching a collar which has been placed on the blades. As shown, each of the blades is somewhat longer than half the length of the collar. The fixed blade 53 has an inclined outer end edge 53*c* corresponding to one inclined end edge c of the collar and a curved upper edge 53*b* corresponding to the concavely curved lower edge b of the collar. The end edge of blade 53 opposite the inclined end edge 53*c* is designated 56. This may be generally at right angles to the carriage 25, as shown. The fixed blade 53 has slots 57 extending up from its lower edge and is removably secured to the upstanding leg 29 of the carriage on the front face of this leg by means of screws 59 extending through the slots threaded in tapped holes in leg 29. The second or movable blade 55 is removably mounted on an auxiliary carriage or slider 61 which is slidable longitudinally of the main carriage 25 in back of the upstanding leg 29 of the main carriage. This slider is mounted on an arm 63 extending up from a tubular guide 65 slidable on a guide rod 67 carried by the carriage 25 extending longitudinally of the carriage 25 below the level of leg 27. The slider slides longitudinally of the carriage 25 in the space between the leg 29 and a bar 69 carried by the carriage 25 extending longitudinally of the carriage 25 in back of leg 29. The movable blade 55 has an inclined outer end edge 55*c* inclined oppositely to edge 53*c* of the fixed blade 53 and corresponding to the other inclined end edge c of the collar, and a curved upper edge 55*b* corresponding to the concavely curved lower edge b of the collar. The end edge of blade opposite the inclined end edge is designated 71. It may be generally at right angles to the carriage 25, as shown. The movable blade 53 has slots like slots 57 extending up from its lower edge and is removable secured on the front face of the slider 61 by means of screws 75 (see FIG. 11) extending through the slots threaded in tapped holes in the slider.

Figures 11, 12, 18:
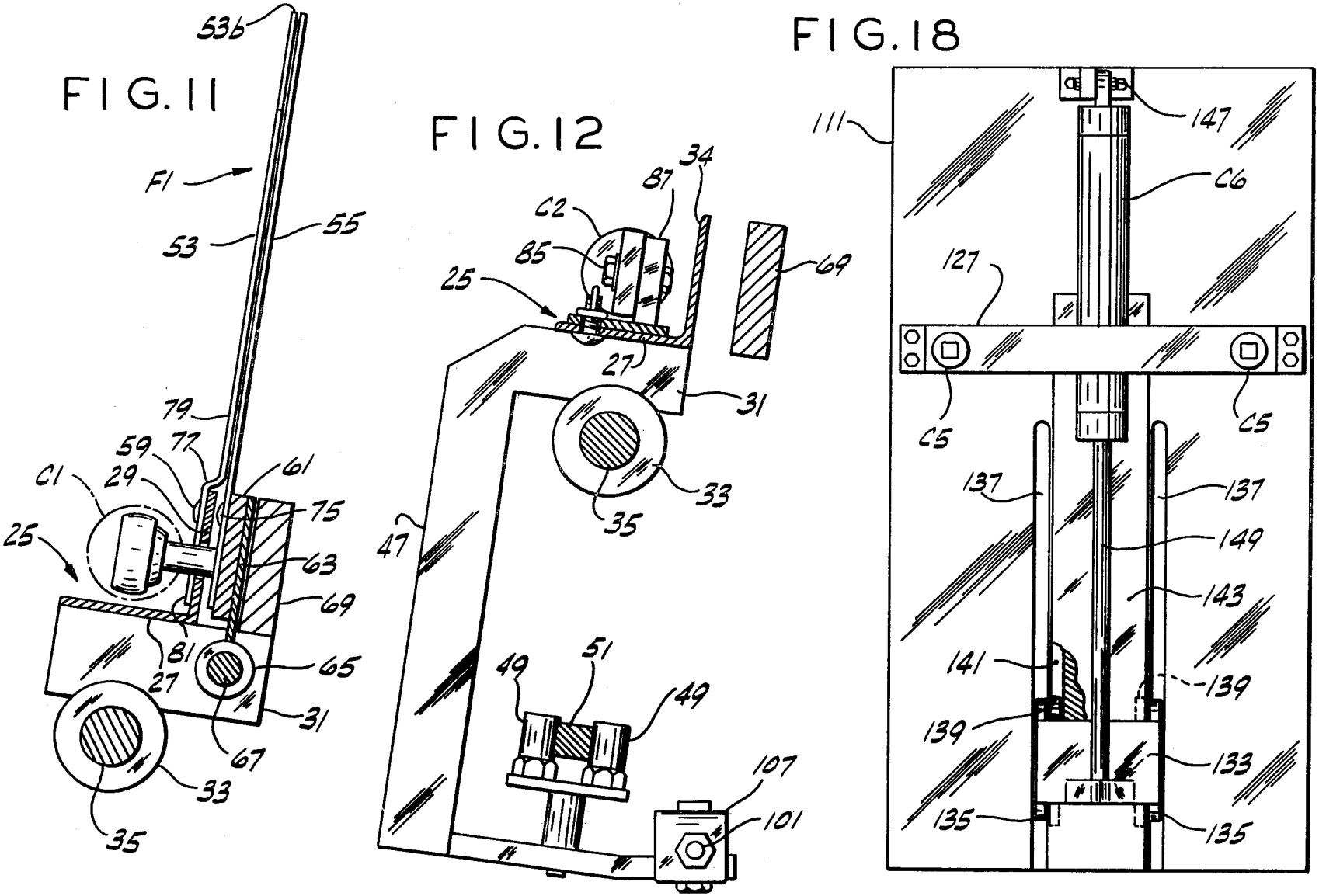
FIG. 11 (sheet 7) is an enlarged section on line 11—11 of FIG. 8.
FIG. 12 (sheet 7) is an enlarged section on line 12—12 of FIG. 8.
FIG. 18 (sheet 7) is a rear elevation of the trimming and turning unit.
Figure 13:
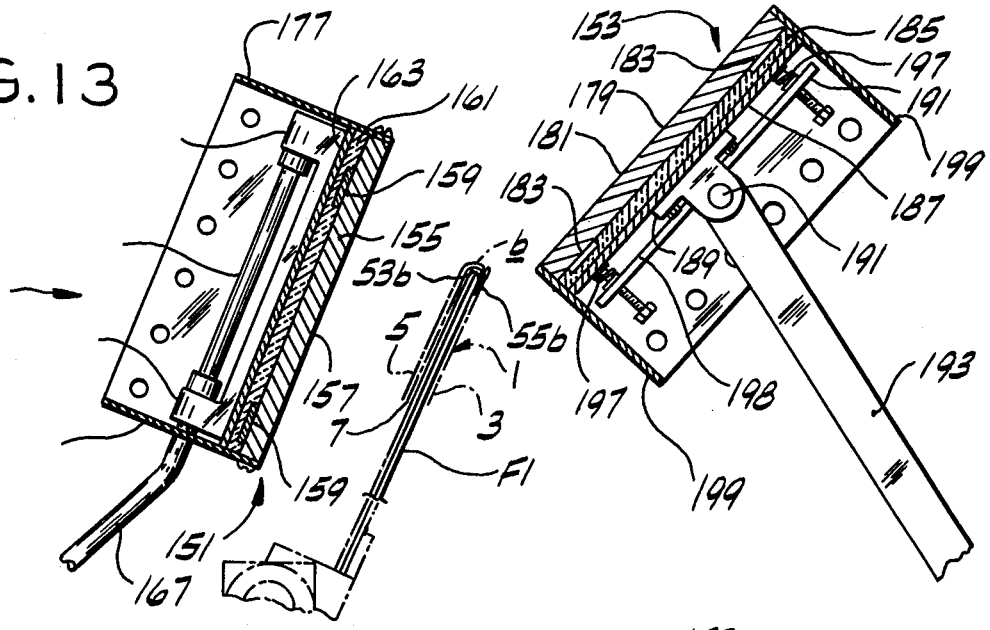
FIG. 13 (sheet 8) is a view in section of the two platens of one of two presses of the apparatus, showing them in their open (retracted) position.

The first or fixed blade 53 of the form F1 extends up from the leg 29 of the carriage 25 and is bent as indicated at 77 in FIG. 12 to have its upper collar-receiving section 79 offset rearward from its lower section 81 (which has the slots 57 receiving the screws 59 holding the blade to leg 29) and in an inclined plane slightly to the rear of the inclined plane of the leg 29. The movable blade 55 (on the slider 61) extends up from the slider 61 with part of its length behind the fixed blade 51 and slidable behind the fixed blade contiguous to the rear face of the fixed blade. The movable blade 55 is movable toward its retracted position to enable placement of a collar on the fixed and movable blades, and away from its retracted position for stretching the collar by means of an air cylinder C1 pinned at one end as indicated at 85 on a support 87 on the bottom leg 27 of the carriage. This support 87 is adjustable longitudinally on leg 27 as indicated at 89 for adjusting the position of the cylinder C1 and hence adjusting the position of the slider 61 and blade 55 relative to blade 53. The piston rod of the air cylinder extends from the piston therein through the other end of the cylinder, and is coupled as indicated at 91 to a pin 93 extending forward from the slider 61 through an elongate slot 95 in the upstanding leg 29 of the carriage 25. The arrangement is such that by retracting the piston rod into the cylinder C1, the slider 61 is moved in the direction toward the fixed blade 53 of the form to slide the movable blade 55 behind the fixed blade to the point where the upper end 55*d* of the outer inclined edge 55*c* (the right-hand edge) of the movable blade is spaced from the upper end 53*d* of the outer inclined edge 53*c* (the left-hand edge) of the fixed blade a distance less than the length of the collar 1 as measured from one point to the other of the collar (points 53*d* and 55*d* of the blades correspond to the points of the collar). This enables a collar (i.e., a turned collar) to be placed on the blades 53 and 55 with the blades between the interliner 7 and the ply 3 of the collar and with the interliner and ply 5 in front of the blades and ply 3 in back of the blades (see FIG. 25). Then, on subsequent extension of the piston rod out of the cylinder C1, then slider 61 is moved in the direction away from the fixed blade 53 to move the movable blade 55 outward away from the fixed blade for stretching the collar flat. Due to the inclination of blade edges 53*c* and 55*c* and the collar end edges c, the collar is stretched, and is held stretched for the ensuing pressing operation, as will appear.

The left-hand (the second) form F2 is basically identical to the first form F1, and the same reference numerals are used to designate parts of the second corresponding to parts of the first except that the air cylinder for form F2 is designated C2. The latter is arranged opposite to cylinder C1, i.e., where cylinder C1 extends to the right from its pin 85, cylinder C2 extends to the left from its pin 85.

Figure 7:
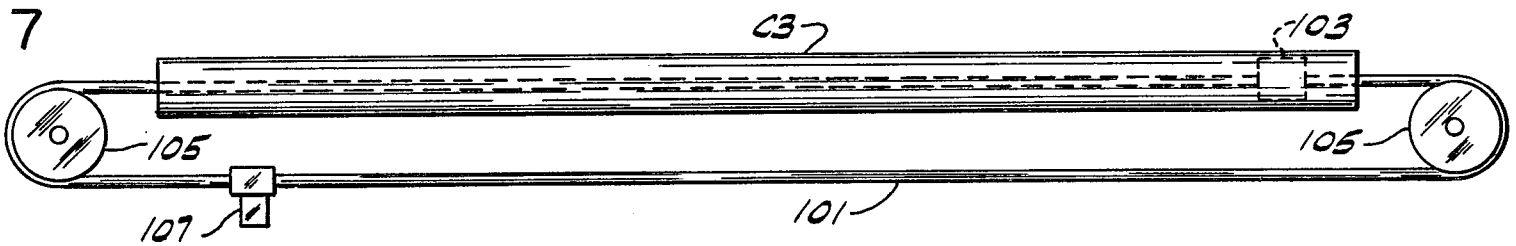
FIG. 7 (sheet 6) is a view showing a drive means for moving a carriage which carries two forms each adapted to hold and to stretch a collar for pressing FIG. 8 (sheet 6) is a view showing the carriage and the two forms.

The main carriage 25, which carries the first (right-hand) form F1 and the second (left-hand) form F2, is movable between a first position toward the left (see FIG. 1) as viewed from the front of the apparatus wherein the second (left-hand) form F2 is in the second (left-hand) press P2 and the first (right-hand) form F1 is at the loading station LS between the two presses for application of a collar thereto, and a second position toward the right wherein the first (right-hand) form F1 is in the first (right-hand) press P1 and the second (left-hand) form F2 is at the loading station. Reciprocation of the carriage 25 between its said two stated positions is effected by an air cylinder and cable system comprising an air cylinder C3 (FIGS. 1 and 7) having a cable 101 extending from one side of its piston 103 through one end of the cylinder around pulleys 105 and through the other end of the cylinder to the other side of the piston, with a connection at 107 between the cable and the carriage 25.

The collar trimming and turning means 11 and 15, as illustrated, is similar to the trimming and turning means of the aforesaid AUTOPRESS II Model 9900 Collar Machine sold by Teledyne Amco of Reading, Pennsylvania; reference may also be made in this respect to the aforesaid U.S. Pat. No. 3,633,799. Referring especially to FIGS. 1 and 16–19, the trimming and turning means is shown to comprise a mechanism plate 111 mounted on the frame 41 of the apparatus at the collar loading station LS, with the plate inclined rearward off vertical about 14½° from bottom to top, corresponding to the inclination of leg 29 of the carriage 25. The upper turning points 13 extend downwardly from the ends of a crosshead 113 pivotally mounted as indicated at 115 for swinging movement on a horizontal axis in front of and adjacent the top of plate 111. Each upper turning point comprises a relatively narrow flat bar having a pointed lower end 23, the latter being spaced laterally with respect to one another a distance L2 less than the length L of the collar 1 from point-to-point. This enables the runstitched collar to be applied to the upper turning points 13, open edge a of the collar uppermost, and drawn up on the turning points to position the collar thereon with the V-shaped lower ends 23 of the turning points in effect wedged in the points of the collar, the sides of the V-shaped lower ends engaging the stitching 9 at the collar points. The upper turning points are suitably mounted for up and down adjustment on the crosshead. The crosshead 113 is operable by an air cylinder C4 mounted on plate 111 to swing the upper turning points from the retracted solid-line position of FIG. 17 wherein the points are spaced from V-shaped trimmer anvils or cutter blocks 119 mounted on plate 111 to the dotted-line position of FIG. 17 wherein the points hold a collar thereon against blocks 119 for the trimming off of the points of the collars at 16. The trimming is effected by means of V-notched trimmer heads or cutters 121 movable rearward from their forward solid-line position of FIG. 17 to their rearward dotted-line position of FIG. 17 to trim the collar points. The heads are mounted on the forward ends of the piston rods 123 of air cylinders C5 mounted in back of plate 111 as indicated at 127.

The lower turning points 19 are mounted in sockets 129 which extend upwardly and diverge outwardly in upward direction from a crosshead 131 at the forward end of a carriage 133 having side arms 135 movable up and down in vertical slots 137 in plate 111, and guided for up and down movement by means of rollers 139 on the arms 135 riding in grooves 141 at opposite sides of a track 143 on the back of the plate. The points 19 extend up out of the sockets, diverging outwardly in upward direction, their tips generally being spaced the distance L2. The carriage 133 is movable up and down by an air cylinder C6 mounted in back of plate 111 as indicated at 147. The arrangement is such that, with the piston rod 149 of cylinder 145 extended, the lower turning points occupy the lowered position in which they are shown in solid lines in FIGS. 16 and 17; by retracting the piston rod, the lower turning points are raised to bring their tips 21 up into engagement with the points of a collar 1 on the upper turning points 13.

Figure 14:
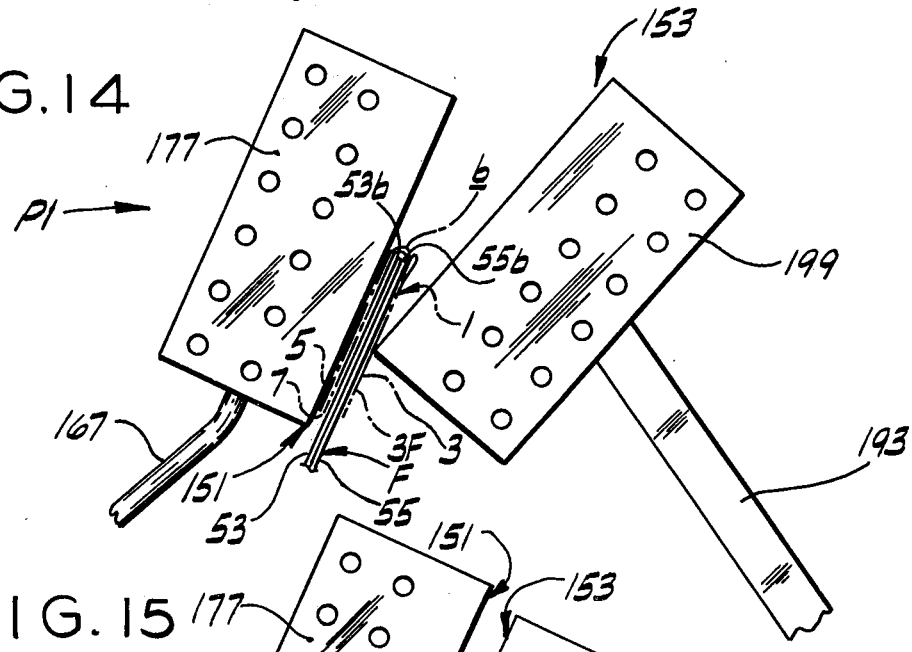
FIGS. 14 and 15 (sheet 8) are views showing the platens in moved positions, FIG. 14 showing an intermediate position and FIG. 15 the closed position.

The press P1 comprises a pair of platens 151 and 153 for pressing engagement with opposite faces of a collar (the workpiece) on the form F1 (the holding means) when the latter with the collar thereon is in pressing position in the press. The platens are movable away from one another to an open (retracted) position (see FIGS. 4–6, and 13) wherein they are spaced apart for entry therebetween of the form F1 and toward one another to cause them to press the opposite faces of the collar on the form. As the platens come into engagement with the collar (FIG. 14), a relative movement occurs as between at least one of the platens, specifically the platen 153, and the form in a direction to effect a wiping action over the outer ply 3 of the collar in the direction away from edge b of the collar thereby drawing the outer ply 3 down on the form F1 in the direction away from the upper edge 53*b*, 55*b* of the form. The platen 151, which is toward the front of the apparatus from platen 153, is referred to as the backup platen; and the platen 153 is referred to as the wiping platen.

The back-up platen 151 comprises a flat rectangular plate 155 having a planar face 157 engageable with the front face of the collar on the form F1. Plate 155 is heated by means of electrical resistance strip heaters such as indicated at 159 extending across the other face of the plate, these heaters being covered by a layer of insulation 161. A sheet metal panel 163 is fastened to the plate overlying the insulation. The back-up platen 151 is pivotally mounted as indicated at 165 at the upper end of a rod 167 which extends upwardly and rearwardly (on an incline) from the upper end of a relatively long arm 169 pivoted at its lower end as indicated at 171 on the frame 41 of the apparatus for swinging movement about a horizontal axis extending transversely of the apparatus at the lower part of the frame. The rod 167 is adjustably mounted at the upper end of the arm as indicated at 173. The arm is swingable forward and rearward by an air cylinder C7*a* for opening and closing the back-up platen. A cover for the back-up platen is indicated at 177.

The wiping platen 153 comprises a flat rectangular plate 179 having a front planar face 181 engageable (with the stated wiping action) on the rear face of the collar on the form F1. Plate 179 is heated by means of strip heaters 183 (similar to heaters 159) extending across the rear face of the plate, these heaters being covered by a layer of insulation 185. A sheet metal panel 187 overlies the insulation. The wiping platen is secured on a pivot member 189 pivotally mounted as indicated at 191 on the upper end of an arm 193 pivoted at its lower end as indicated at 195 for swinging movement about a horizontal axis extending transversely of the axis above and rearward of the axis of arm 169 at 171. The wiping platen is backed by springs 197 reacting from a head 198 secured to the upper end of the arm 195. A cover for the wiping platen is indicated at 199. Arm 193 is swingable rearward and forward for opening and closing the wiping platen by an air cylinder C8*a*. Arm 193, when in its rearward (retracted position) is angled up and forward from its pivot at 195, the wiping platen 153 (in its open position) being located somewhat above and rearward of form F1. Then, as the arm swings forward and down, it carries the wiping platen forward and down into engagement with the rear face of the collar on form F1 with a downward wiping action of the planar face of the wiping platen on the rear face 3*f* of the collar.

The left-hand (the second) press P2 is basically identical to the first press P1, and the same reference numerals are used to designate parts of the second corresponding to the first, except that the air cylinders for the second are specially designated C7*b* and C8*b*.

Means indicated generally at U1 is provided for unloading a collar after it has been pressed in the press P1 from the form F1 before the form F1 is moved out of the press P1, and means indicated generally at U2 is provided for unloading a collar after it has been pressed in the press P2 from the form F2 before the form F2 is moved out of the press P2. When a collar on form F1 has been pressed in press P1, this press opens up, form F1 is collapsed to enable the collar to be picked up off the form, and unloader U1 operates to pick the collar up off the form, and deliver it to a stack of completed collars on a stacking platform T1 in front of press P1. Similarly, when a collar on form F2 has been pressed in press P2, this press opens up, form F2 is collapsed to enable the collar to be picked up off the form, and unloader U2 operates to pick the collar up off the form and deliver it to a stack of completed collars on a stacking platform T2 in front of press P2.

The first (the right-hand) unloader U1 (see particularly FIGS. 2, 4–6 and 20) comprises an open rectangular frame 211 pivoted for swinging movement at its lower end as indicated at 213 about a horizontal axis which extends in transverse direction with respect to the apparatus. This frame 211 has right and left sides 215 and 217, a bottom member 219, a top member 221 and a cross brace 233 adjacent to its lower end. An elevator 225 is movable up and down on the frame 211, this elevator comprising a crossbar 227 extending from side to side of the frame and having a bracket 229 at its left side carrying guide rollers 231 which roll up and down on the left side of the frame, and having a tubular guide 233 at its right end slidable on a guide rod 235 at the right-hand side of the frame. An air cylinder C9*a*, pinned at its lower end as indicated at 239 at the right side of the frame, has its piston rod 241 extending out of its upper end and pin-connected at 243 to the elevator 225 for raising and lowering the elevator.

The elevator 225 includes forwardly extending arms 247 and 249 at the forward ends of which are tubular guides 251 and 253. These guides are coaxial with their axis extending transversely of the apparatus. Both rotatable and axially slidable in these guides is a shaft 225. Fixed on this shaft at 257 between the guides is an arm 259 extending radially from the shaft and carrying a bar constituting a gripper supporting head 261 at its free end, this head extending transversely of the arm 259 like the head of a T. An air cylinder C10*a* pivoted at 265 on the carriage 225 has its piston rod 267 pin-connected as indicated at 269 to a crank 271 extending from the arm 259, with the pin connection at 269 being such as to permit axial sliding of the shaft 255 in the guides 251 and 253. An air cylinder C11*a* has its piston rod (not shown) connected to the shaft 255 to slide the shaft axially in the guides, for a purpose that will appear.

The gripper head 261 is part of a gripper assembly comprising a shaft 275 extending lengthwise of the head in front of the head journalled at its ends in bearings 277 at the ends of the head. The assembly further comprises a pair of grippers each designated in its entirety by the reference numeral 279, these grippers being located adjacent the ends of the head. Each comprises a finger 281 carried by the shaft swingable toward and away from a finger 283 carried by the head. These fingers are adjustably slidable lengthwise of the head, the fingers 283 being secured to brackets 285 adjustable lengthwise of the head via fasteners 287 extending through slots 289. The shaft 275 extends through the sides of the brackets. Fingers 281 have hubs 291 on the shaft between the sides of the brackets, these hubs being axially slidable but nonrotatable on the shaft. The brackets back against the head and are thus nonrotatable on the shaft. An air cylinder C12*a* pin connected at 295 on the arm 269 has its piston rod 297 pin-connected at 299 to a crank 301 on the shaft 275 for rocking the shaft to open and close the movable gripper fingers. The head 261 also carries fingers 303 intermediate the two grippers.

Figure 2:
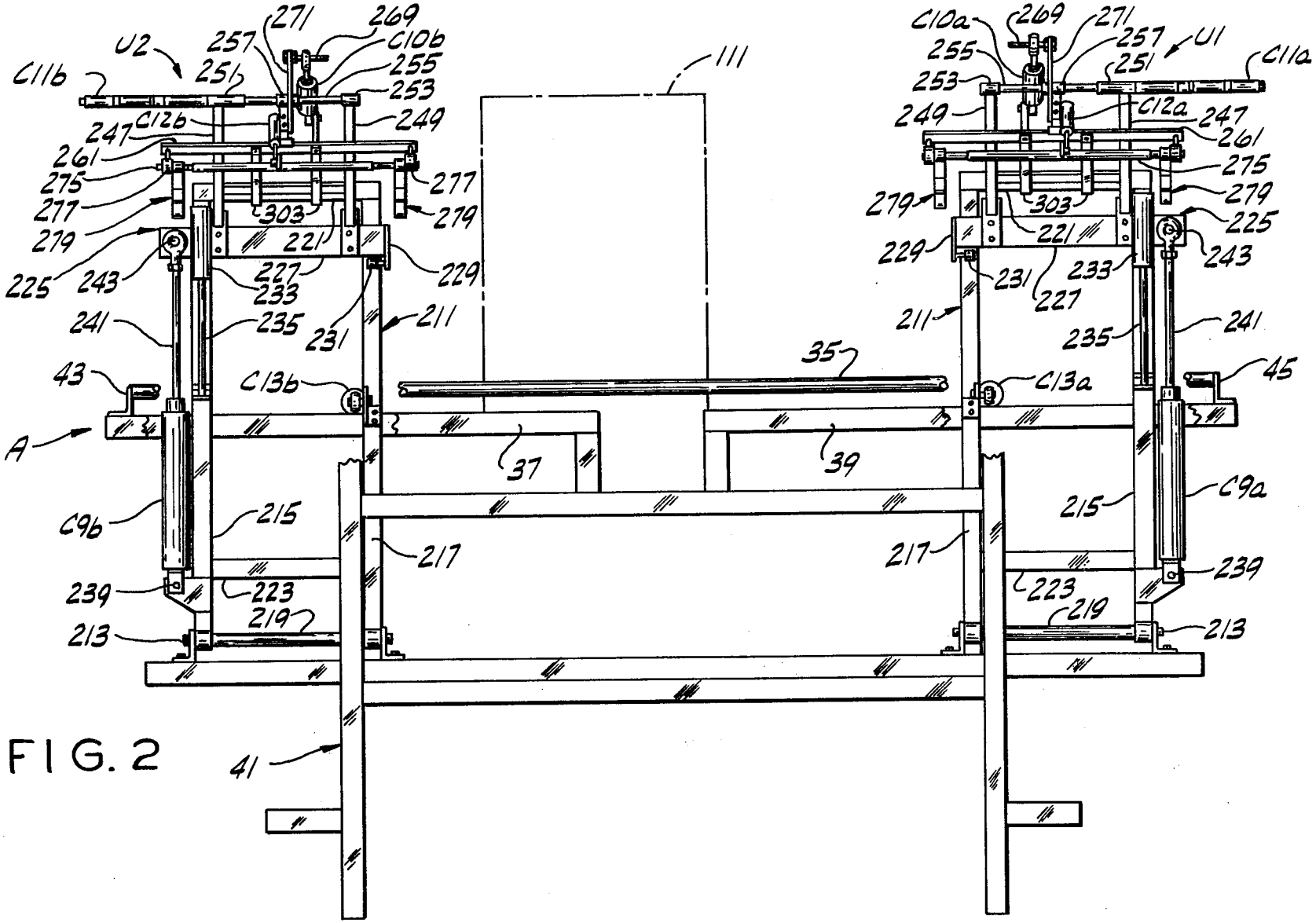
FIG. 2 (sheet 2) is a view similar to FIG. 1 with parts further broken away.
Figure 3:
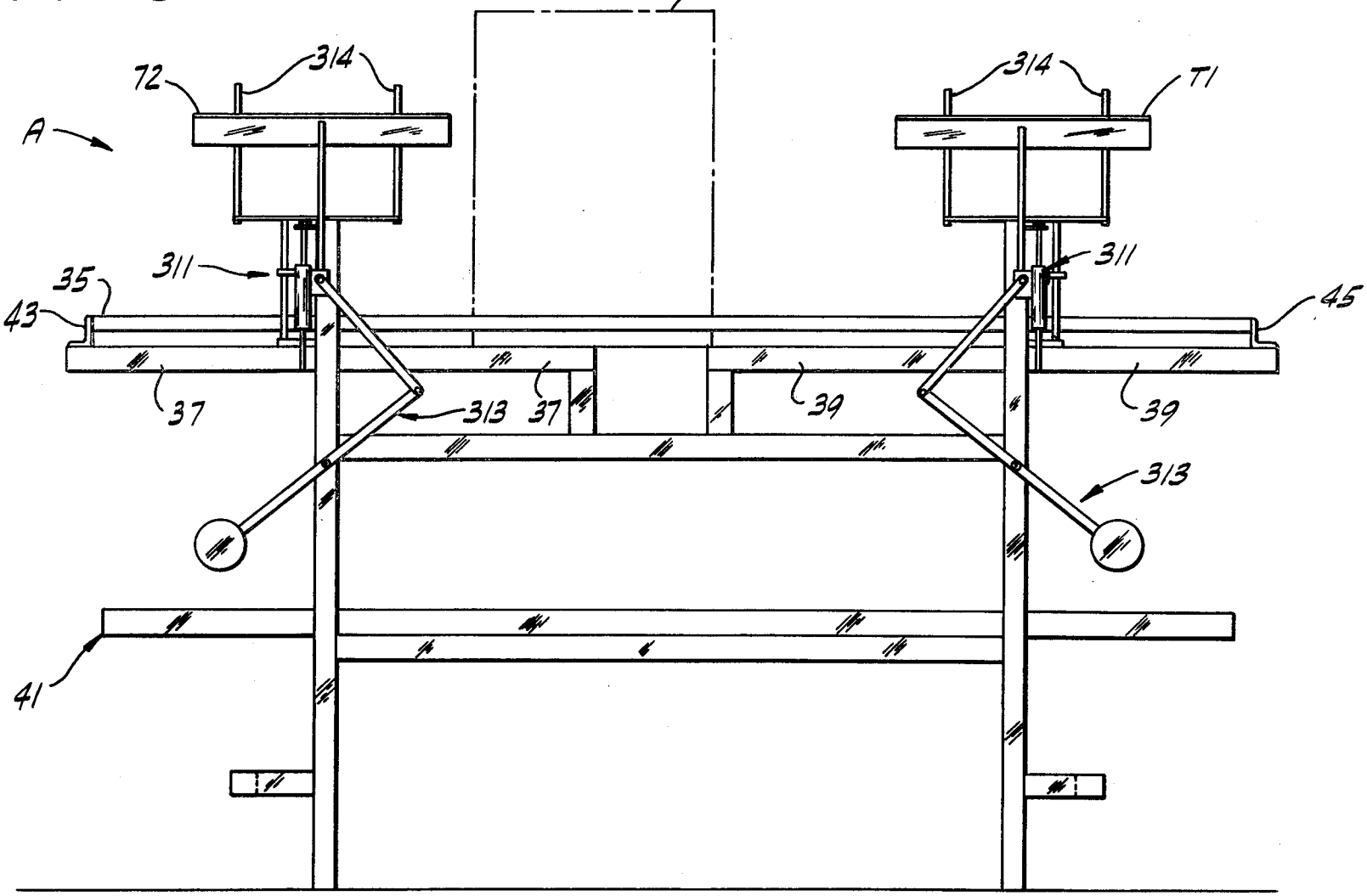
FIG. 3 (sheet 3) is a front elevation showing parts omitted from FIG. 1, and with parts shown in FIG. 1 omitted.
Figure 5:
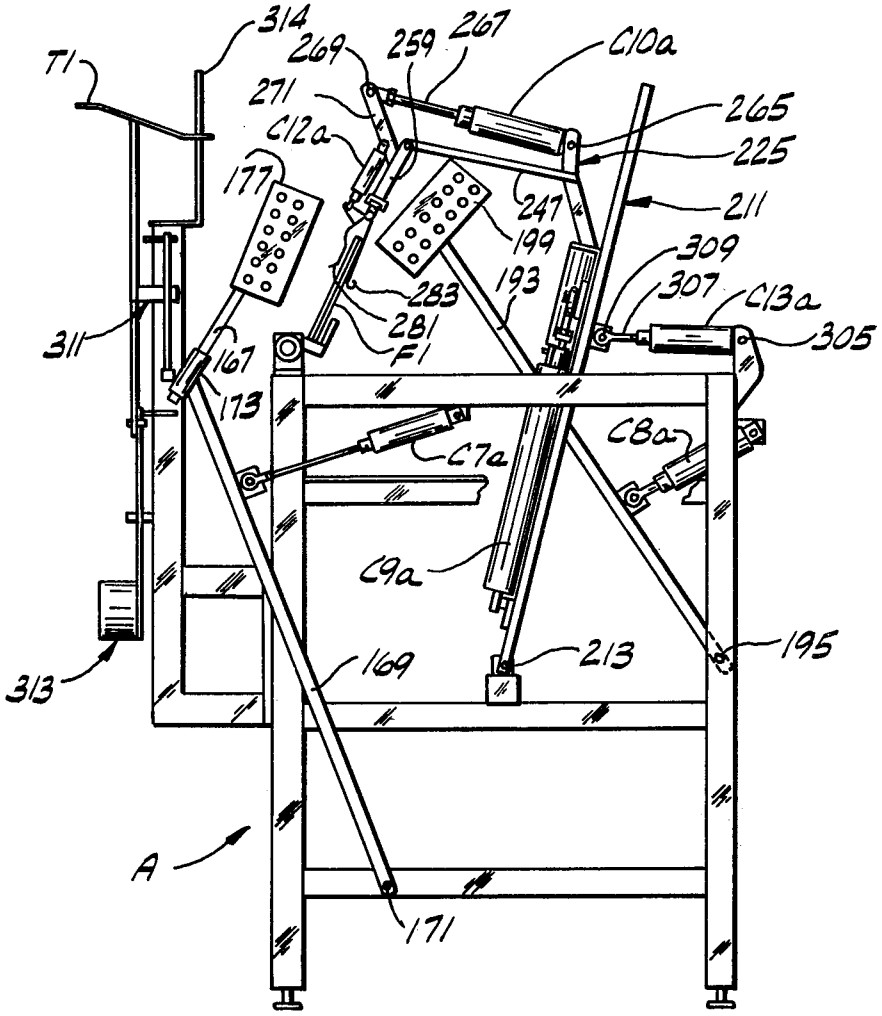
FIG. 5 (sheet 4) is a view similar to FIG. 4 showing the press platens open after pressing a collar and the unloader in a position for gripping a collar and moving it up and out from between the platens.
Figure 4:
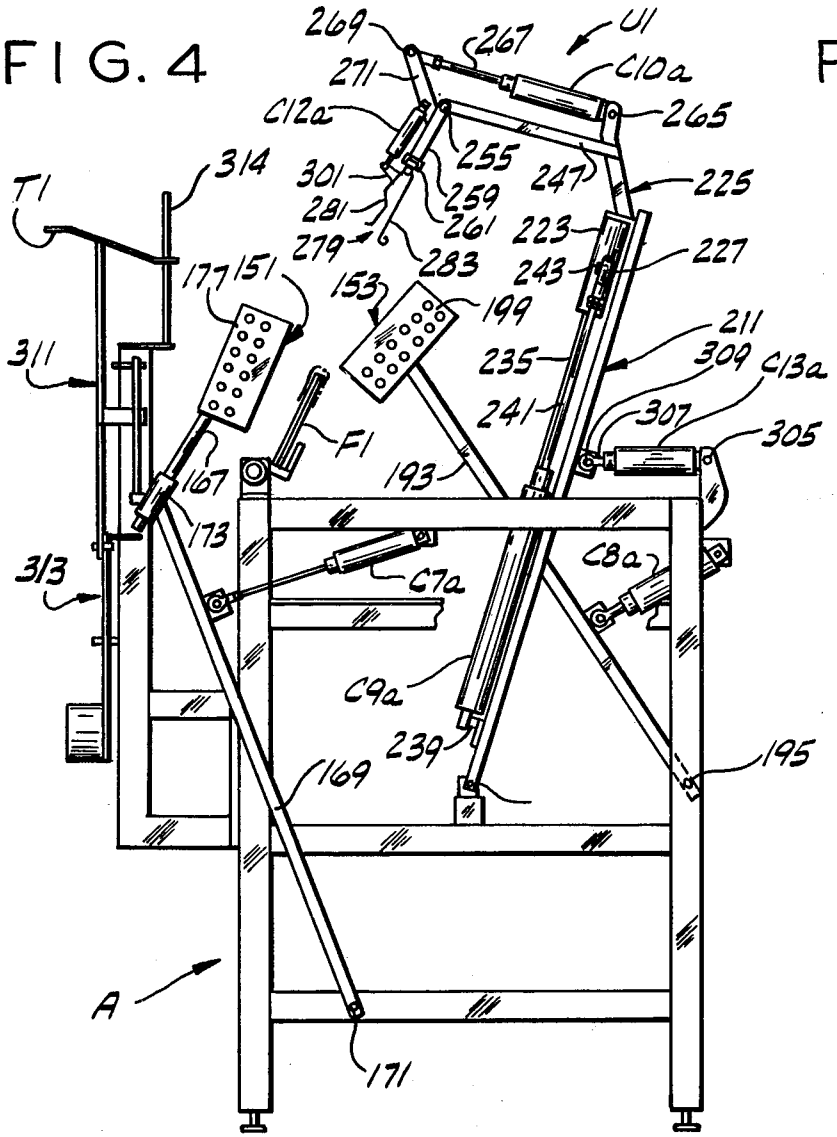
FIG. 4 (sheet 4) is an end elevation of the apparatus as viewed from the right end of FIG. 1, showing press platens in an open position, and an unloader in a retracted position.
Figure 19:
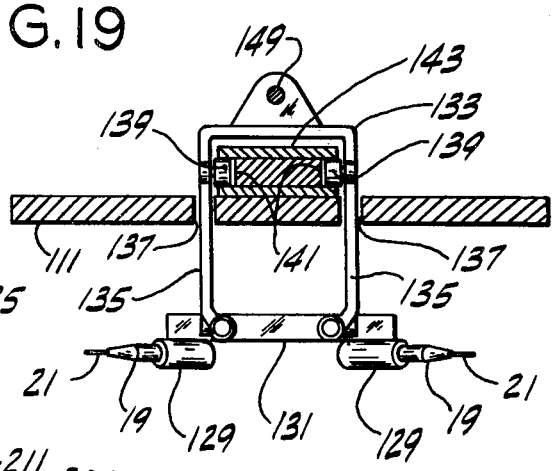
FIG. 19 (sheet 5) is a section on line 19—19 of FIG. 16, on a smaller scale than FIG. 16.
Figure 6:
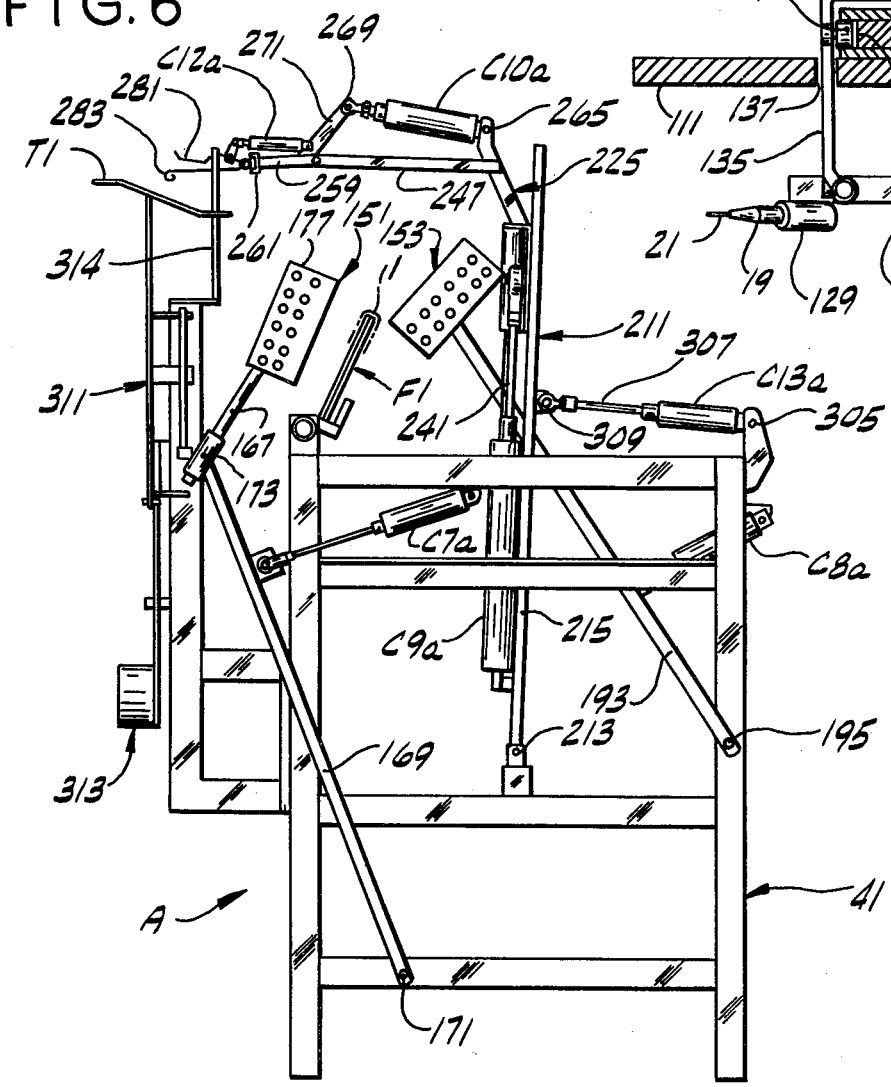
FIG. 6 (sheet 5) is a view similar to FIG. 5 showing the unloader delivering a pressed collar to a collar stacking platform.
Figure 10:
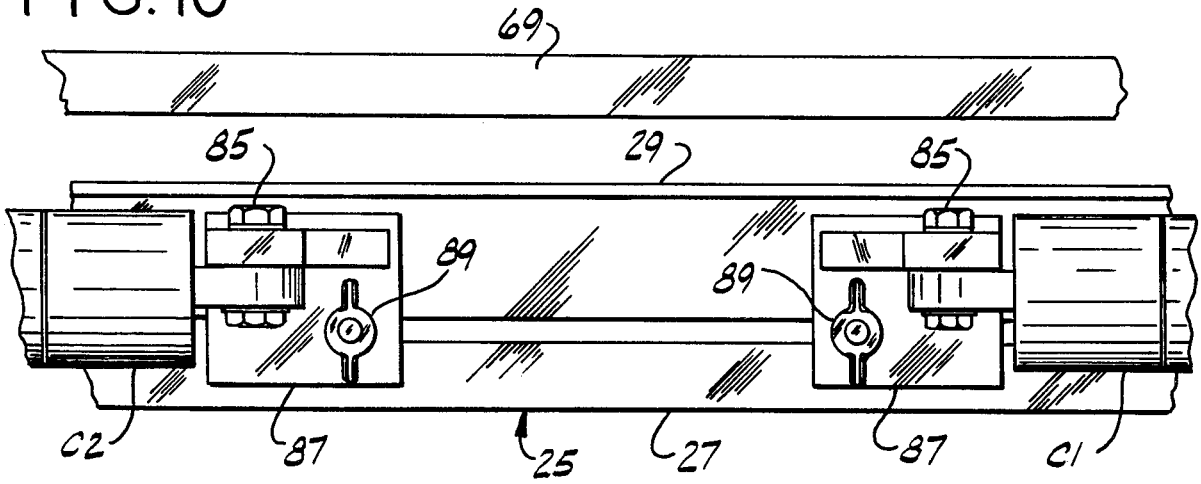
FIG. 10 (sheet 5) is an enlarged fragment of FIG. 9.

An air cylinder C13*a* pin-connected at 305 on the frame 41 of the apparatus has its piston rod 307 pin-connected at 309 to the swinging unloader frame 211 to swing it between its rearward retracted position of FIGS. 4 and 5, wherein it is angled back toward the rear of the apparatus, and its forward delivery position of FIG. 6, wherein it extends up generally vertically from its pivot at 213. The elevator 225 is normally in the raised position in which it is illustrated in FIGS. 2 and 4. The air cylinder C10*a* is operable to swing arm 259 carrying the gripper head 261 between the downwardly extending collar pick-up position of the arm in which it is illustrated in FIGS. 4 and 5, and the forwardly extending delivery position of the arm in which it is illustrated in FIG. 6. The arrangement is such that when the swinging frame 211 is in its retracted position and the arm 259 is in its downwardly extending pick-up position, the grippers 279 are located to straddle the collar on form F1 in its position in the press P1. That is, the fixed fingers 283 of the grippers 279 are located to extend down in the back of the collar on the form F1, and the movable fingers 281 of the grippers 279 are located to extend down in front of the collar on the form F1 (see FIGS. 4 and 5).

Thus, with frame 211 in its rearward retracted position, with arm 259 in its downwardly extending pickup position, and with grippers 279 open (by means of cylinder C12*a*) the grippers 279 are movable downwardly to straddle the collar 1 on form F1 in press P1 (this press being open) via operation of air cylinder C9*a*. Then, on operation of air cylinder C1 to collapse the form F1, operation of air cylinder C12*a* to close the grippers 279 to grip the collar, and operation of air cylinder C9*a* to raise the elevator 225 with accompanying operation of air cylinder C11*a* to shift the collar (gripped by the grippers) laterally toward the left (as viewed in FIGS. 1 and 20) to clear the collar from the point 53*d* (the upper right- left-hand corner) of blade 53 of form F1, the collar is picked up off the form F1. The lateral shift is needed to enable the collar to clear the form as the collar moves up. Subsequently, via operation of air cylinder C10*a* to swing arm 259 up to its forwardly extending delivery position, and operation of air cylinder C13*a* to swing the frame 211 forward, the collar 1 is delivered to a position over the platform T1 for being stacked as will appear.

The platform T1 is guided for vertical movement as indicated at 311, and counterbalanced as indicated at 313, the arrangement being such that the platform moves downwardly as collars are stacked up one on top of another on the platform, thereby to maintain the top of the stack of collars generally at a constant level. The frame 211 is swung to its forward position (see FIG. 6) to deliver a collar for stacking with the elevator 225 raised and the grippers 279, gripping the collar, extending forward from the head 261 on arm 259 in a generally level attitude.

This brings the collar above the platform; then the elevator 225 is lowered via operation of air cylinder C9*a* to lower the collar. The grippers 279 are opened to release the collar, and the frame 211 is swung back to its retracted position by cylinder C9*a*, the collar being prevented from being dragged back with the grippers 279 by its engagement with a pair of stripper pins 314 extending up above the platform T1.

The second (the left-hand) unloader U2 is basically identical to the first unloader U1, and the same reference numerals are used to designate parts of the second corresponding to the first, except that the air cylinders for the second are specially designated C9*b*–C13*b*. The second unloader delivers a pressed collar from the form F2 in press P2 following opening of press P2 and collapse of form F2 to a position over platform T2 for stacking the collar on platform T2. The latter is guided for vertical movement, and counterbalanced in the same manner as platform T1, and has stripper pins 314 associated with it corresponding to the stripper pins associated with platform T1.

Figure 26:
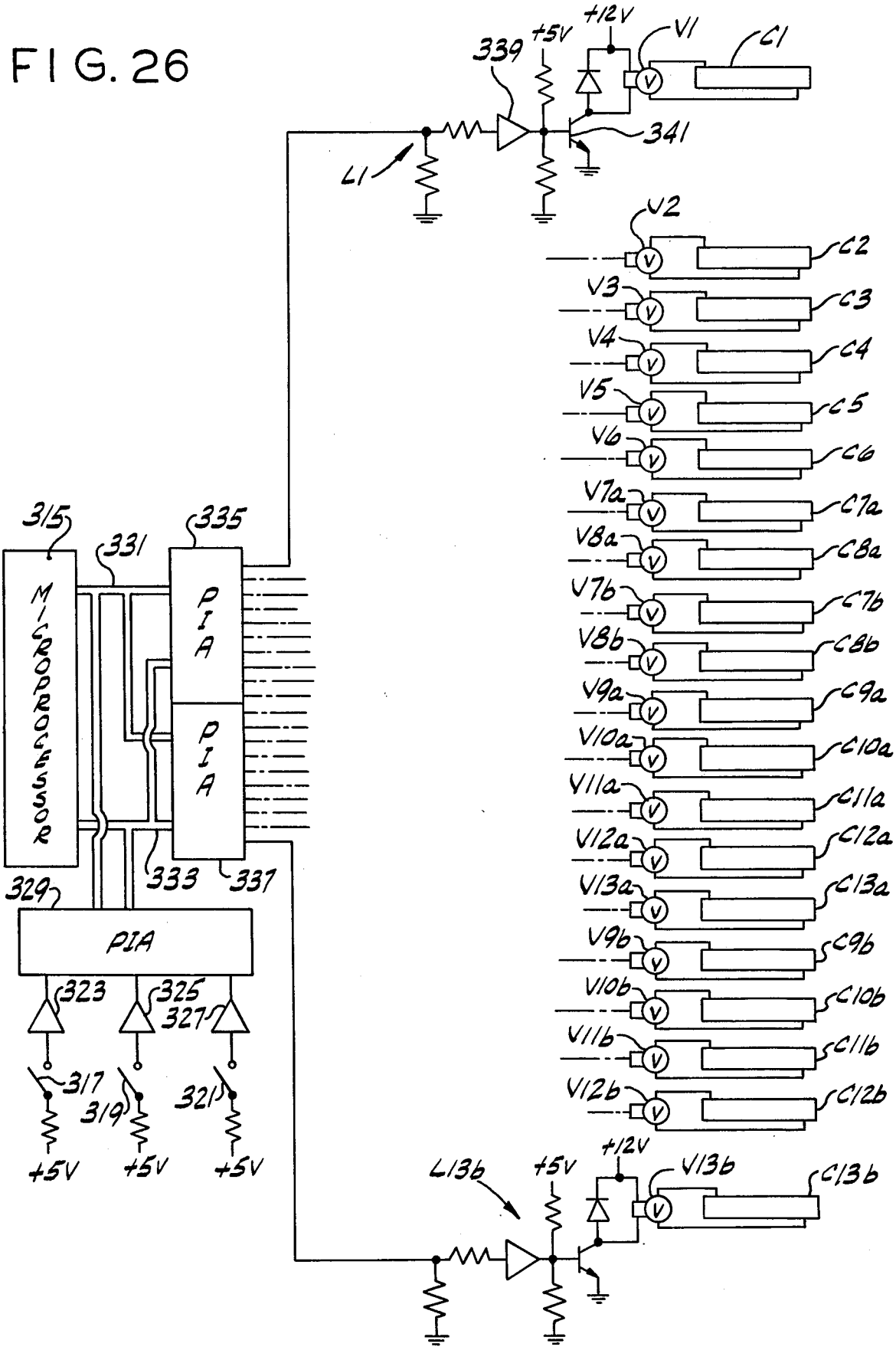
FIG. 26 (sheet 12) is a pneumatic and electrical circuit diagram.

As shown in FIG. 26, the air cylinders C1–C6, C7*a*–C13*a* and C7*b*–C13*b* are controlled by solenoid valves V1–V6, V7*a*–V13*a* and V7*b*–V13*b*, respectively, these valves being connected in a circuit under the control of a microprocessor 315, which in turn is controlled by the operator by means of three switches 317, 319 and 321. Switch 317 is preferably a foot pedal switch; it controls the trimming of the collar. Switch 319 is also preferably a foot pedal switch; it is operable after a collar has been applied to a form F1 or F2 in its collapsed condition to expand the form to stretch the collar on the form. Switch 321 is preferably a push-button switch, it is operable when a form (F1 or F2 as the case may be) has been expanded to stretch a collar on the form to cause the apparatus to cycle through a program involving movement of the expanded form with the collar thereon into a press (P1 or P2, as the case may be), closure of the press to press the collar with the previously described wiping action, opening of the press, and operation of the respective unloading means (U1 or U2, as the case may be) to pick up the collar off the form and deliver it to the receiving means consituted by the respective stacking platform (T1 or T2, as the case may be).

When any one of switches 317, 319 or 321 is closed, a high is supplied via a respective buffer 323, 325, 327 to a peripheral interface adapter (PIA) 329. The high is supplied from PIA 329 to the microprocessor 315 over a data bus 331, indicating to the microprocessor which switch is closed. At 333 is indicated an address bus, which functions to select either PIA 335 or PIA 337 for exchange (transmission or reception) of data over the data bus. The pins of PIA 335 and PIA 337 are connected to circuits such as that indicated at L1 for valve V1 and L13*b* for valve V13*b* comprising a buffer 339 and an NPN transistor 341. The microprocessor controls the actuation of any of the valves by addressing the proper PIA over the address bus 333 and, by means of the data bus, causing the pin of that PIA corresponding to the valve to be actuated to go High. The High is supplied from that pin to the respective buffer 339, causing the respective transistor 341 to conduct and thereby provide a circuit from a supply (e.g., the +12V supply shown) through the solenoid of the valve and through the transistor to ground, thus actuating the valve. For example, valve V1 is actuated when the top pin of PIA 335 goes high; valve V13*b* is actuated when the bottom pin of PIA 337 goes high. The circuits for the other valves are not shown in detail in FIG. 26 to avoid unnecessary duplication; each corresponds to L1 and L13*b*. It will be understood that a suitable memory (not shown) is associated with the microprocessor, and that suitable sensors (not shown) may be provided in the circuit for proper sequencing of the steps of the operation of the apparatus.

Figure 17:
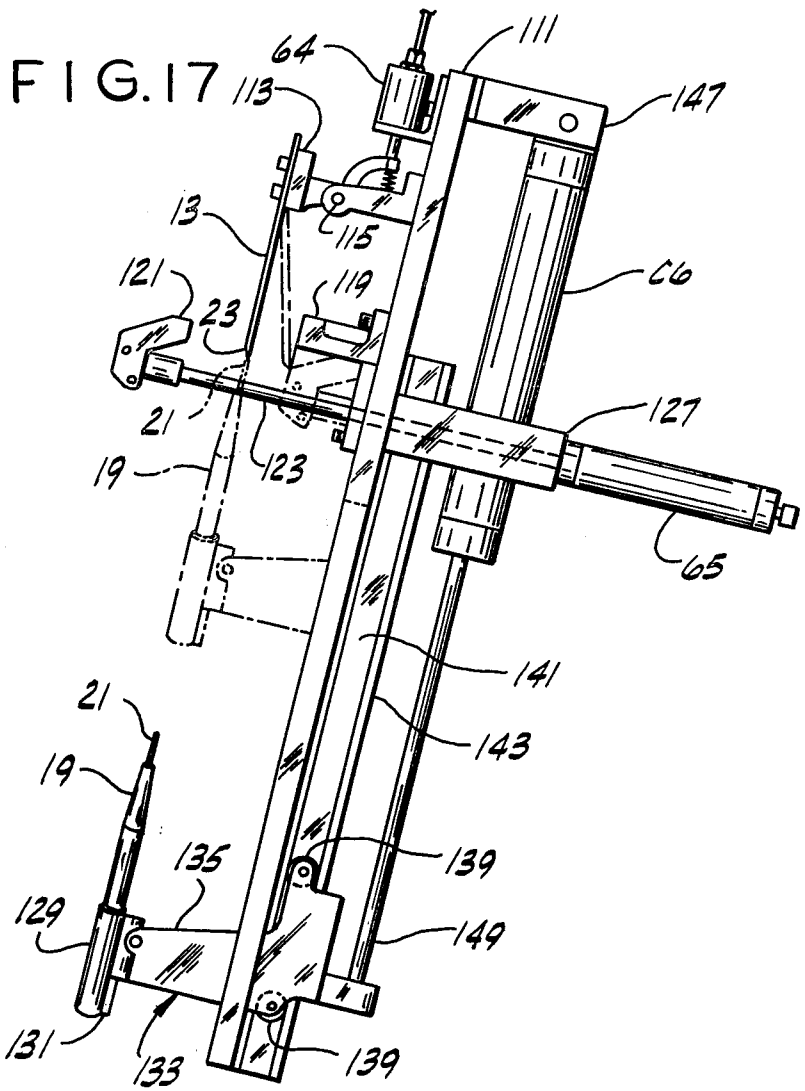
FIG. 17 (sheet 9) is a side elevation of the trimming and turning unit, as viewed from the right of FIG. 16.

Operation is as follows:

For the description of the operation of the apparatus, it will be assumed that the carriage 25 is in its stated first position shown in solid lines in FIG. 1, with form F1 at the loading station LS and form F2 in press P2; forms F1 and F2 are collapsed; the upper turning points 13 are in their retracted (forward) position shown in solid lines in FIG. 17; the trimmer heads 121 are in their retracted (forward) position shown in solid lines in FIG. 17; the lower turning points 19 are in their lowered position shown in solid lines in FIGS. 16 and 17; both presses P1 and P2 are open; and all movable parts of the unloaders U1 and U2 are in their retracted position.

The operator applies a runstitched collar 1 such as shown in FIG. 21 with its edge a (where the collar plies 3, 5 and 7 are free of one another) to the upper turning points 13, pulling the collar up on these turning points for entry of the turning points in the points of the collar. The collar is applied with its plies 7 and 5 in front and its ply 3 in back of the upper turning points 13. The operator then steps on the foot pedal switch 317 and holds it down, and the apparatus then proceeds through the following steps of a cycle of operation, the microprocessor 315 being programmed for carrying them out in the stated sequence:

1. Valve V4 is energized to actuate cylinder C4 to swing the upper turning points 13 rearward to their position shown in phantom in FIG. 17, thereby bringing the points of the collar 1 back against the anvils 119 for the trimming of the collar points.

2. Valve V5 is energized to actuate cylinders C5 to drive the trimmer heads 121 rearward to trim off the collar points as indicated at 16 in FIG. 23 (note the V-shape of the trim).

3. Valve V5 is deenergized to actuate cylinders C5 to return the trimmer heads to their retracted (forward) position shown in solid lines in FIG. 17.

4. Valve V4 is deenergized to actuate cylinder C4 to swing the upper turning points 13 back to their retracted (forward) position shown in solid lines in FIG. 17.

5. Valve V6 is energized to actuate cylinder C6 to move the lower turning points 19 up to the raised position in which they are shown in phantom in FIGS. 16 and 17, wherein their tips 21 engage the trimmed collar points.

While continuing to hold the foot pedal switch 317 down, the operator transfers the collar from the upper turning points 13 to the lower turning points 19, everting (turning) the collar in the process. The collar so applied to the lower turning points has ply 3 in back and plies 5 and 7 in front of these points. The operator then releases the foot pedal switch 317, which results in further operation of the apparatus through the following step, under control of the microprocessor:

6. Valve V6 is deenergized to actuate cylinder C6 to move the lower turning points 19 down to their lowered position, thereby carrying the everted (turned) collar down to the collapsed form F1 at the loading station LS.

Figure 25:
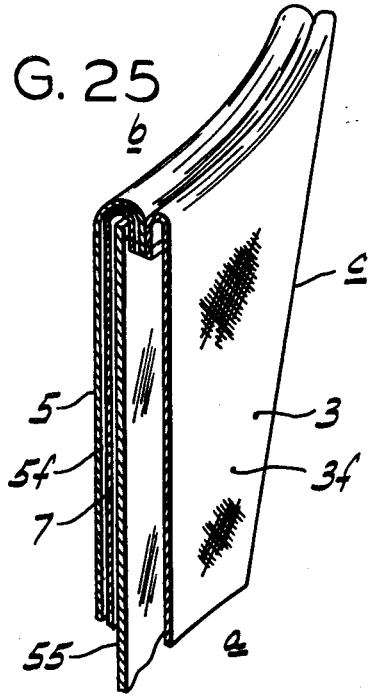
FIG. 25 (sheet 11) is a section on line 25—25 of FIG. 24 showing the turned collar on a form of the apparatus.

As the lower turning points 19 with the everted collar thereon come down toward the collapsed form F1 at the loading station LS, the operator transfers the collar to the form, with ply 3 of the collar in back of the form and plies 5 and 7 in front of the form, and with the upper edge of the form received in the infolded margin of the ply 7 in the manner illustrated in FIG. 25.

Having transferred the collar to the form F1, the operator steps on foot pedal switch 319, which results in further operation of the apparatus through the following step, under control of the microprocessor:

7. Valve V1 is energized to actuate cylinder C1 to expand the form F1 and thereby stretch the collar on the form to form it to its desired shape for the pressing operation.

The operator then releases the foot pedal switch 319 and actuates the push-button switch 321, which results in further operation of the apparatus through the following steps under control of the microprocessor:

8. Valve V3 is actuated to actuate cylinder C3 to move the carriage 25 from its first to its second position, thereby bringing form F1 with the formed collar thereon into the press P1 (which is open) and bringing form F2 (which is in its collapsed condition) out of press P2 (which is open) to the loading station LS.

9. Valve V7*a* is energized to actuate cylinder C7*a* to move the back-up platen 151 of press P1 rearward from its open to its closed position in which it engages the outside face of ply 7 at the front of the form F1 and backs up the form with the collar thereon.

Figure 15:
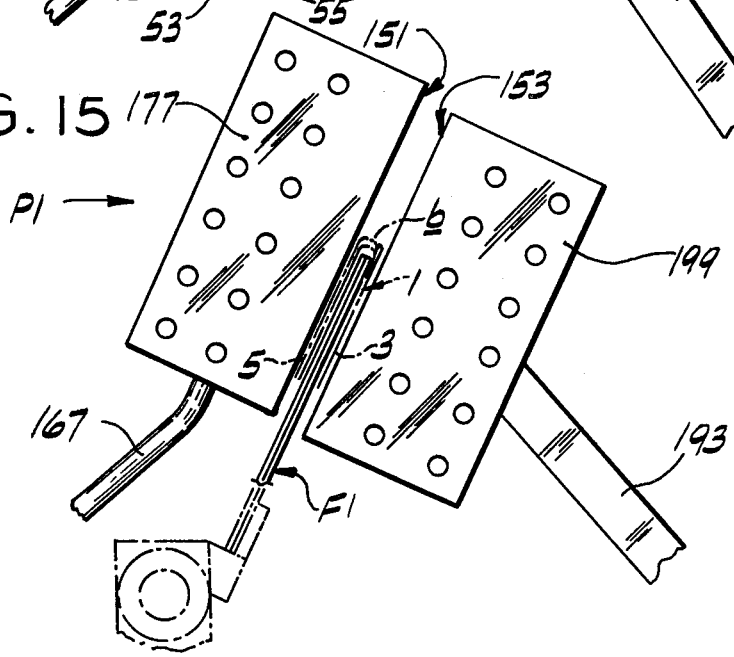

10. Valve V8*a* is energized to actuate cylinder C8*a* to swing the arm 193 of press P1 forward to carry the wiping platen 153 of press P1 forward and down into engagement with the outside face **3*f* of ply 3 of the collar, this ply being on the back of the form, with a downward wiping action of the planar face 181 of the wiping platen on the ply 3 as the wiping platen comes into engagement with the outside face of ply 3 (see FIG. 14) and completes its downward and forward movement (see FIG. 15**), to complete the pressing operation. The platens remain closed for a predetermined time interval (e.g., 2–10 seconds).

11. Valve V8*a* is deenergized to actuate cylinder C8*a* to swing the arm 193 of press P1 rearward to carry the wiping platen 153 back to its open or retracted position of FIG. 4.

12. Valve V7*a* is deenergized (generally simultaneously with deenergization of valve V8*a*) to actuate cylinder C7*a* to move the back-up platen 151 of press P1 back to its open or retracted position of FIG. 4.

13. Valve V9*a* is energized to actuate cylinder C9*a* to lower the elevator 211 of the unloader U1, thereby bringing the grippers 279 (which are open at this time) down into position to grip the collar on the form F1. Gripper fingers 281 come down in front of the form and gripper fingers 283 come down in back of the form.

14. Valve V12*a* is energized to actuate cylinder C12*a* to move the gripper fingers 281 rearward to grip the collar.

15. Valve V1 is deenergized to actuate cylinder C1 to collapse the form F1 for removal of the trimmed, turned and pressed collar.

16. Valve V11*a* is energized to actuate cylinder C11*a* to move the grippers 279, gripping the collar, laterally over to the left as viewed in FIGS. 1 and 2 to move the collar laterally to a position wherein it is adapted to clear the points **53*d* and 55*d* of the blades of the form. This may occur generally simultaneously with the collapse (step 15**) of the form.

17. Valve V9*a* is deenergized to actuate cylinder C9*a* to raise the elevator 211 of unloader U1, thereby picking the collar up off the form, the elevator thus returning to its FIG. 4 position.

18. Valve V10*a* is energized to actuate cylinder C10*a* to swing arm 259 up to its forwardly extending delivery position in which it is shown in FIG. 6.

19. Valve V13*a* is energized to actuate cylinder C13*a* to swing the frame 211 forward (see FIG. 6) for delivery of the collar to a position over the platform T1 for being stacked on the platform.

20. Valve V9*a* is energized to actuate cylinder C9*a* to lower the elevator 211. This brings the collar down in front of the stripper pins 313 (FIG. 6).

21. Valve V12*a* is deenergized to actuate cylinder C12*a* to open the grippers 279 for releasing the collar.

22. Valve V13*a* is deenergized to actuate cylinder C13*a* to swing the frame 211 rearward. The collar, released from the grippers 279, engages the stripper pins 314, is thereby stripped from the grippers, and drops down onto the platform T1 (or onto a stack of previously stacked collars on the platform).

23. Valve V11*a* is deenergized to actuate cylinder C11*a* to move the grippers 279 back to the right.

24. Valve V10*a* is deenergized to actuate cylinder C10*a* to swing the arm 259 down, thus returning the grippers to their FIG. 4 position.

25. Valve V9*a* is deenergized to actuate the cylinder C9*a* to raise the elevator 211, thus returning it to its FIG. 4 position.

While the pressing of a collar on form F1 proceeds in the press P1 and the pressed collar is being unloaded from the form F1, the operator proceeds to apply another collar (runstitched but as yet unturned) to the upper turning points 13, steps on the foot pedal switch 317 to repeat steps 1–5, transfers the collar to the lower turning points 19, everting it in the process as before, then releases the foot pedal switch 317 for a repeat of step 6, and then transfers the collar to the form F2 at the loading station LS. Having transferred the collar to the form F2, the operator steps on foot pedal switch 319 which results in further operation of the apparatus through the following step under control of the microprocessor:

26. Valve V2 is energized to actuate cylinder C2 to expand the form F2 and thereby stretch the collar on the form F2 to form it to its desired shape for the pressing operation.

The operator then releases the foot pedal switch 319 and actuates the push-button switch 321, which results in further operation of the apparatus through the following steps under control of the microprocessor:

27. Valve V3 is actuated to actuate cylinder C3 to move the carriage 25 from its second to its first position, thereby bringing form F2 with the formed collar thereon into the press P2 (which is open) and bringing form F1 (which is in its collapsed condition) out of press P1 (which is open) to the loading station LS.

28. Valve V7*b* is energized to actuate cylinder C7*b* to move the back-up platen 151 of press P2 rearward from its open to its closed position in which it engages the outside face of ply 7 at the front of the form F2 and backs up the form with the collar thereon.

29. Valve V8*b* is energized to actuate cylinder C8*b* to swing the arm 193 of press P2 forward to carry the wiping platen 153 of press P2 forward and down into engagement with the outside face 3*f* of ply 3 of the collar, this ply being on the back of the form, with a downward wiping action of the planar face 181 of the wiping platen on the ply 3 as the wiping platen comes into engagement with the outside face of ply 3 and completes its downward and forward movement to complete the pressing operation. The platens remain closed for a predetermined time interval (e.g., 2–10 seconds).

30. Valve V8*b* is deenergized to actuate cylinder C8*b* to swing the arm 193 of press P2 rearward to carry the wiping platen 153 of press P2 back to its open or retracted position.

31. Valve V7*b* is deenergized (generally simultaneously with deenergization of valve V8*b*) to actuate cylinder C7*b* to move the back-up platen 151 of press P2 back to its open or retracted position.

32. Valve V9*b* is energized to actuate cylinder C9*b* to lower the elevator 211 of the unloader U2, thereby bringing the grippers 279 of this unloader (which are open at this time) down into position to grip the collar on the form F2. Gripper fingers 281 of unloader U2 come down in front of the form F2 and gripper fingers 283 come down in back of the form.

33. Valve V12*b* is energized to actuate cylinder C12*b* to move the gripper fingers 281 of unloader U2 rearward to grip the collar.

34. Valve V2 is deenergized to actuate cylinder C2 to collapse the form F2 for removal of the trimmed, turned and pressed collar.

35. Valve V11*b* is energized to actuate cylinder C11*b* to move the grippers 279 of unloader U2, gripping the collar, laterally over to the right as viewed in FIGS. 1 and 2 to move the collar laterally to a position wherein it is adapted to clear the points 53*d* and 55*d* of the blades of the form. This may occur generally simultaneously with the collapse of the form F2.

36. Valve V9*b* is deenergized to actuate cylinder C9*b* to raise the elevator 211 of unloader U2, thereby picking the collar up off the form F2.

37. Valve V10*b* is energized to actuate cylinder C10*b* to swing the arm 257 of unloader U2 up to its forwardly extending delivery position.

38. Valve V13*b* is energized to actuate cylinder C13*b* to swing the frame 211 of unloader U2 forward for delivery of the collar to a position over the platform T2 for being stacked on the platform.

39. Valve V9*b* is energized to actuate cylinder C9*b* to lower the elevator 211 of unloader U2. This brings the collar down in front of the stripper pins 314 associated with T2.

40. Valve V12*b* is deenergized to actuate cylinder C12*b* to open the grippers 279 of unloader U2 for releasing the collar.

41. Valve V13*b* is deenergized to actuate cylinder C13*b* to swing the frame 211 of unloader U2 rearward. The collar, released from the grippers 279, engages the stripper pins 314, is thereby stripped from the grippers, and drops down onto the platform T2 (or onto a stack of previously stacked collars on this platform).

42. Valve V11*b* is deenergized to actuate cylinder C11*b* to move the grippers 279 of unloader U2 back to the left.

43. Valve V10*b* is deenergized to actuate cylinder C10*b* to swing the arm 259 of unloader U2 down, thus returning the grippers to their downwardly extending position.

44. Valve V9*b* is deenergized to actuate the cylinder C9*b* to raise the elevator 211 of unloader U2.

While the pressing of a collar on form F2 proceeds in the press P2 and the pressed collar is being removed from the form F2, the operator proceeds to apply another collar (runstitched but as yet unturned) to the upper turning points 13, steps on foot pedal switch 317 to repeat steps 1–5, transfers the collar to the lower turning points 19, everting it in the process as before, then releases the foot pedal switch 317 for a repeat of step 6, and then transfers the collar to the form F1 at the loading station LS, all in the same manner as described above for the initial operation on a collar. Having transferred the collar to form F1, the operator steps on foot pedal switch 319 to repeat step 7, and releases 319 and actuates push-button switch 321 to repeat steps 8–25 for pressing the collar on form F1 in press P1. This is followed by operation on the next collar by means of form F2 and press P2 (a repeat of steps 1–6, and then steps 26 and 27–44), and so on.

It will be observed that in the pressing operation on a collar in either of the presses P1 or P2, the back-up platen 151 backs up the outer ply 5 of a collar 1 on the form (F1 or F2, as the case may be) in the press and the wiping platen 153, as it is brought forward and down from its retracted position (shown for platen 153 of press P1 in FIG. 13), moves partly into engagement with the outside face 3*f* of ply 3 at a region spaced down from the upper edge 53*b*, 55*b* of the form, and then moves into further engagement with the outside face 3*f* of ply 3 while wiping over the latter in downward direction away from edge 53*b*, 55*b*. This makes the bottom edge of the collar neat and even, without any manual rolling of the edge. Since the apparatus enables trimming, turning and loading of a collar on a form (F1 or F2) at the loading station LS while a collar is being pressed and unloaded, it is adapted for rapid processing of collars, substantially reducing the processing time per collar.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. Apparatus for processing workpieces such as parts of garments each of which comprises two or more superimposed plies of material which have been seamed adjacent an edge thereof and which are unseamed at an edge opposite the seamed edge, said apparatus comprising:

means for holding a workpiece in a turned condition with the seam inturned, the plies of the workpiece thereby having inturned margins at said edge joined by the seam, said holding means being adapted to extend between plies of the workpiece from the unseamed edge thereof and having an edge which is receivable in the infolded margin of a ply and which is engageable with the workpiece at its seamed edge;

a press for pressing a workpiece on the holding means, said press comprising a pair of platens for pressing engagement with opposite faces of the workpiece on the holding means, said platens being relatively movable away from one another to a retracted position wherein they are spaced apart and thereby open for entry therebetween of the holding means carrying a workpiece between the platens with one face of the workpiece facing toward the first platen and its other face facing toward the second platen;

the holding means being movable from a loading station spaced from the press, where a workpiece may be applied to the holding means in the stated turned condition, to a pressing position between the opened platens, and the apparatus having means for moving the holding means between said loading station and said pressing position, and means for effecting relative movement of the platens for closure thereof to press the opposite faces of the workpiece on the holding means and concomitantly effecting a relative movement of at least one of the platens and the holding means in a direction to effect a wiping action on the workpiece drawing it in the direction away from the seamed edge of the workpiece held at said edge of the holding means toward the unseamed edge of the workpiece.

2. Apparatus as set forth in claim 1 wherein one platen constitutes a back-up platen and the other a wiping platen and the apparatus has means for moving the back-up platen from its retracted position, after the holding means has moved to said pressing position, into position engaging and backing up one face of the workpiece on the holding means, and means for moving the wiping platen, upon movement of the back-up platen to its workpiece engaging position, into engagement with the other face of the workpiece and wiping upon said other face in the direction away from the seamed edge of the workpiece held at said edge of the holding means.

3. Apparatus as set forth in claim 2 for processing workpieces each comprising two outer plies and an interliner, originally seamed with the two outer plies one on the other and the interliner on the outside of one of said outer plies, the workpiece in its turned condition on the holding means having one outer ply and the interliner on the inside of said one outer ply on one face of the holding means and the other outer ply on the other face of the holding means, the edge of the holding means being received in the infolded margin of the interliner, and wherein the arrangement is such that the wiping platen comes into pressing engagement with the outside face of said other outer ply of the workpiece and, as it comes into engagement therewith and, before its completes its closing movement, wipes over said outside face of said other outer ply in the direction away from said edge.

4. Apparatus as set forth in claim 3 wherein the holding means comprises a relatively thin flat form for forming the workpiece to a desired shape, wherein the form, when in the pressing position between the platens, is in a predetermined plane, wherein the back-up platen has a planar face engageable flatwise with the outside face of the said one outer ply of the workpiece on the form, and wherein the wiping platen has a planar face engageable flatwise with the outside face of said other outer ply of the workpiece on the form, said face of the wiping platen being movable partly into engagement with said outside face of said other outer ply of the workpiece at a region spaced from said edge of the form and then into further engagement with said outside face of said other outer ply while wiping over the latter in the direction away from said edge.

5. Apparatus as set forth in claim 4 wherein said wiping platen is mounted for swinging movement from its retracted position into engagement with said outside face of said other outer ply of the workpiece on the form about an axis so located as to effect the stated wiping action.

6. Apparatus as set forth in claim 4 wherein the form is collapsible and expansible endwise, being collapsed for application of a workpiece thereto and then expanded for stretching the workpiece endwise.

7. Apparatus as set forth in claim 6 for processing runstitched collars each comprising two outer plies and an interliner stitched along one end, the bottom and the other end of the collar and open at the top of the collar, the ends being inclined, and wherein the form comprises a pair of blades mounted for relative sliding movement one against the other, said blades having a bottom edge corresponding to the top edge of the collar and constituting the stated edge of the form, and end edges which are inclined to correspond to the inclined ends of the collar.

8. Apparatus as set forth in claim 7 having a carriage movable to move the form from said loading station to said pressing position, one of the blades of the form being secured to the carriage, the other blade being movable with and also movable relative to the carriage, and means for moving said movable blade relative to the carriage to extend and retract said movable blade.

9. Apparatus as set forth in claim 7 having a main carriage movable to move the form from said loading station to said pressing position, one of the blades of the form being removably secured to the main carriage, an auxiliary carriage carried by and movable relative to the main carriage, the other blade being removably secured to the auxiliary carriage, and means associated with the main and the auxiliary carriages for moving the auxiliary carriage relative to the main carriage to extend and retract the movable blade.

10. Apparatus as set forth in claim 7 having means for unloading a pressed collar from the form.

11. Apparatus as set forth in claim 10 wherein said unloading means comprises gripping means for gripping a pressed collar on the form, means for moving said gripping means into position for gripping a collar on the form, causing the gripping means to grip the collar, and then moving the gripping means away from the form to remove the collar from the form, the form being collapsed for removing the collar.

12. Apparatus as set forth in claim 11 having means for moving the gripping means laterally to shift the collar endwise relative to the form for the removal of the collar from the form.

13. Apparatus as set forth in claim 12 wherein the means for moving the gripping means is operable following the removal of the collar from the collapsed form to move the gripping means to a position for delivery of the collar to a stacking means.

14. Apparatus as set forth in claim 7 having means at the loading station for trimming a collar, a set of turning points for receiving the collar from the trimming means, said turning points being movable between a position for receiving the collar from the trimming means with accompanying eversion of the collar to a position adjacent the form at the loading station for transfer of the everted collar to the holding means at the loading station.

15. Apparatus as set forth in claim 1 having means for unloading a pressed workpiece from the holding means.

16. Apparatus as set forth in claim 15 wherein said unloading means comprises gripping means for gripping a pressed workpiece on the holding means, and means for moving said gripping means into position for gripping a workpiece on the holding means, causing the gripping means to grip the workpiece, and then moving the gripping means away from the holding means to remove the workpiece from the holding means.

17. Apparatus as set forth in claim 16 wherein the means for moving the gripping means is operable following the removal of the workpiece from the holding means to move the gripping means to a position for delivery of the workpiece to a stacking means.

18. Apparatus as set forth in claim 1 having means for effecting turning of a workpiece and moving the turned workpiece to the loading station for application of the turned workpiece to the holding means at the loading station.

19. Apparatus as set forth in claim 18 having means for trimming the workpiece before turning it and moving it to the loading station.

20. Apparatus as set forth in claim 1 wherein the holding means is collapsible and expansible, and wherein means is provided for collapsing the holding means for application of a workpiece to the holding means and for removal of a workpiece from the holding means and for expanding the holding means for stretching the workpiece.

21. Apparatus for processing workpieces such as parts of garments each of which comprises two or more plies which have been seamed adjacent an edge thereof, said apparatus comprising means for holding a workpiece for being pressed, means for pressing a workpiece on the holding means, and means for unloading a pressed workpiece from the holding means comprising gripping means for gripping a pressed workpiece on the holding means, and means for moving said gripping means into position for gripping a workpiece on the holding means, causing the gripping means to grip the workpiece, and then moving the gripping means away from the holding means to remove the workpiece from the holding means.

22. Apparatus as set forth in claim 21 wherein the means for moving the gripping means is operable, following removal of the workpiece from the holding means, to move the gripping means to a position for delivery of the workpiece to a stacking means.

23. Apparatus as set forth in claim 1 wherein the holding means is collapsible and expansible, being collapsed for application and removal of a workpiece, and wherein the apparatus has means for collapsing the holding means for application of the workpiece, and for removal of the workpiece after it has been pressed.

24. Apparatus as set forth in claim 1 having a plurality of holding means each adapted to hold a workpiece for pressing, and means for moving each holding means to the loading station for application of a workpiece thereto and to pressing position for pressing of the workpiece thereon.

25. Apparatus as set forth in claim 24 having a first and a second holding means and a first and a second press, said holding means being conjointly movable between a first position wherein the second holding means is at the loading station and the first holding means is in the first press and a second position wherein the first holding means is at the loading station and the second holding means is in the second press.

26. Apparatus as set forth in claim 25 having a first unloading means for unloading a pressed workpiece from the holding means in the first press and a second unloading means for unloading a pressed workpiece from the holding means in the second press.

27. Apparatus for processing runstitched collars each comprising two outer piles and an interliner stitched along one end, the bottom and the other end of the collar and open at the top of the collar, the ends being inclined, comprising:

a relatively thin flat form adapted to extend between the plies of a collar and to form it to shape, said form comprising a pair of blades mounted for relative sliding movement one against the other, said blades having a top edge corresponding to the bottom edge of the collar, and end edges which are inclined to correspond to the inclined end of the collar with points corresponding to the points of the collar;

means for effecting relative sliding movement of the blades between a collapsed position wherein the points of the blades are spaced a distance less than the length of a collar between the points of the collar, to an expanded position within a collar for stretching the collar endwise;

a press for pressing a collar stretched on the form;

means mounting the form for movement into the press for pressing a collar on the form and for movement out of the press after the collar has been pressed;

a carriage movable to move the form, one of the blades being secured to the carriage, the other blade being movable with and also movable relative to the carriage; and means associated with the carriage for moving said movable plate relative to the carriage to extend and retract said movable blade.

28. Apparatus as set forth in claim 27 wherein said one blade is removably secured to said carriage, and wherein the other blade is removably secured to an auxiliary carriage carried by and movable relative to the main carriage, and having means for moving the auxiliary carriage relative to the first-mentioned carriage to extend and retract the movable blade.

29. The method of processing a workpiece such as part of a garment which comprises two or more superimposed plies of material which have been seamed adjacent an edge thereof and which are unseamed at an edge opposite the seamed edge, said method comprising:

applying the workpiece to a holding means in a turned condition with the seam inturned, the plies of the workpiece thereby having inturned margins at said edge joined by the seam, the holding means extending between plies of the workpiece from the unseamed edge thereof and having an edge received in the infolded margin of a ply and engageable with the workpiece at its seamed edge;

positioning the holding means with the turned workpiece thereon between a pair of pressing platens; and effecting relative movement of the platens for closure thereof to press the opposite faces of the workpice on the holding means and concomitantly effecting a relative movement of at least one of the platens and the holding means in a direction to effect a wiping action on the workpiece drawing it in the direction away from the seamed edge of the workpiece held at said edge of the holding means toward the unseamed edge of the workpiece.

30. The method of claim 29 for processing a run-stitched collar comprising two outer plies and an interliner stitched along one end, the bottom and the other end of the collar and open at the top of the collar, the ends being inclined, wherein the holding means which is used is a relatively thin flat form, the collar is applied in turned condition to the form with one outer ply and the interliner on the inside of said one outer ply on one face of the form and the other outer ply on the other face of the form, said edge being received in the infolded margin of the interliner, the wiping action being effected on said other outer ply.

31. The method of claim 30 wherein one platen backs up the said one outer ply and the other is moved partly into engagement with the outside face of said other outer ply at a region spaced from said edge and then into further engagement with said outside face of said other outer ply while wiping over the latter in the direction away from said edge.

* * * * *